US005679488A

United States Patent [19]

Itami et al.

[11] Patent Number: 5,679,488

[45] Date of Patent: Oct. 21, 1997

[54] ELECTROPHOTOGRAPHY PHOTORECEPTOR

[75] Inventors: Akihiko Itami; Yoshiaki Takei; Chikusa Fukumoto; Takeo Oshiba; Yoshihiko Etoh, all of Hachioji, Japan

[73] Assignee: Konica Corporation, Japan

[21] Appl. No.: 556,131

[22] Filed: Nov. 9, 1995

[30] Foreign Application Priority Data

Nov. 15, 1994 [JP] Japan ..... 6-280465
Jan. 25, 1995 [JP] Japan ..... 7-009957

[51] Int. Cl.[6] ..... G03G 5/047; G03G 5/147

[52] U.S. Cl. ..... 430/58; 430/66; 430/67

[58] Field of Search ..... 430/58, 66, 67

[56] References Cited

U.S. PATENT DOCUMENTS

| | | | |
|---|---|---|---|
| 4,515,882 | 5/1985 | Mammino et al. | 430/66 |
| 4,606,934 | 8/1986 | Lee et al. | 430/67 |
| 4,647,521 | 3/1987 | Ogichi et al. | 430/58 |
| 4,654,288 | 3/1987 | Hiro et al. | 430/67 |
| 5,096,795 | 3/1992 | Yu | 430/59 |
| 5,162,183 | 11/1992 | Lindblad et al. | 430/58 |

OTHER PUBLICATIONS

Derwent Publ.Ltd. London, GB; AN 92-429420 XP002011352 & JP-A-04 326 359 (Matsushita), 16 Nov. 1992 Abstract.

Patent Abstr. of Japan, vol. 13, No. 341 (P-907) Jul. 31, 1989 JP-A-01 099058 (Seiko) Apr. 17, 1989 Abstract.

Database WPI 9250, Derwent Publ.Ltr. GB, AN 92-412573 XP002011353 & JP-A-04 310 960 (Konica) Nov. 2, 1992 Abstract.

*Primary Examiner*—Roland Martin
*Attorney, Agent, or Firm*—Jordan B. Bierman; Bierman, Muserlian and Lucas LLP

[57] ABSTRACT

Disclosed is an electrophotographic photoreceptor comprising a conductive support and provided thereon an intermediate layer, a carrier generation layer and a carrier transport layer, wherein an outermost layer of said electrophotographic photoreceptor contains silica particle each containing an aluminium ingredient of not more than 1000 ppm, a calcium ingredient of not more than 300 ppm and a iron ingredient of not more than 1000 ppm, and said silica particles have a volume average particle size of 0.05 through 5 μm.

18 Claims, 7 Drawing Sheets

ELECTROPHOTOGRAPHY PHOTORECEPTOR

FIELD OF THE INVENTION

The present invention relates to an electrophotographic photoreceptor comprising silica particles in its outermost layer and, more specifically, the present invention relates to an electrophotographic photoreceptor having excellent durability.

Further, the present invention relates to an electrophotographic apparatus and a unit therefor.

BACKGROUND OF THE INVENTION

Usually, image-forming process comprises steps of electrifying the surface of a photoreceptor, imagewise exposing and developing, to form a toner image, transferring said toner image to a transfer material, fixing the toner image thereto and cleaning the residual toner and de-electrification of the photoreceptor, and these steps are repeated for a long period of time.

Accordingly, for the photoreceptor it is required that it has excellent properties not only in the electrophotographic properties such as electrification property, photosensitivity, dark attenuation property and residual electrical potential property, but also in physical properties such as copying durability, anti-abrasion property, anti-moisture property as well as in the durability against ozone irradiation which generates upon corona discharging and durability against imagewise exposure.

On the other hand, as for the electrophotographic photoreceptor, inorganic photoconductive material such as amorphous silicon, selenium and cadmium sulfide have popularly been used in the art. However, recently, organic photoconductive photosensitive materials have become more popular in the viewpoint of low cost, low toxicity, easy processability and freedom of selection according to its purpose.

Fatigue and deterioration of these electrophotographic photosensitive materials due to repeated use are often due to abrasion and damage of the surface of the photoreceptor during steps of transfer of a toner image formed on the photoreceptor to a transfer material, separation and cleaning of residual toner after transfer, and decomposition or degeneration of the photosensitive layer during the steps of electrification, imagewise exposure, de-electrification, etc.

Accordingly, in order to prevent fatigue and deterioration of the above-mentioned photoreceptors, improvement of the surface of the photosensitive layer is an important problem to be solved. Particularly, photosensitive layer formed of the organic photoreceptor material is relatively soft in comparison with that formed of an inorganic photosensitive material, and fatigue and deterioration of a photoreceptor is relatively larger after repetitive use and, thus, improvement of the surface of the above-mentioned photosensitive layer becomes more important.

Japanese Patent O.P.I. Publication Nos. 117245(1981), 91666(1988) and 205171(1989) disclose a technology of enhancing mechanical strength of the surface of a photosensitive material by incorporating into the outermost layer silica particles. Further, Japanese Patent O.P.I. Publication Nos. 176057(1982), 117558(1986) and 155558(1991) disclose a technology of enhancing mechanical strength as well as conferring on the photosensitive material lubricating property, to obtain photosensitive having excellent durability, by incorporating in the outer-most layer of a photosensitive material the above-mentioned silica particles which were made hydrophobic silica particles by treated with a silane coupling agent.

Conventionally, as for fine silica particles, those produced in the liquid phase and those manufactured in the gaseous phase have been known in the art. However, they are all extremely small particles of several tens Angstroms to several hundreds Angstromes and it has been difficult to obtain particles having required size distribution according to the purpose. It is considered to be quite difficult to stably manufacture the particles with high purity.

On the other hand, the above-mentioned silica particles consist of hard, clear fine particles, and as described in the above-mentioned respective references, they were used for the purpose of enhancing durability of the photoreceptor by incorporating in the outermost layer thereof.

However, during the process of conducting image formation repeatedly for a long period of time, electrophotographic properties are degraded by the effect of impurities contained in the silica particles and there causes a problem that stable surface electric potential on the surface of the photosensitive layer may not be obtainable.

This problem cannot be solved by the hydrophobic treatment of the silica particles and deterioration in the electrophotographic properties may be invited during the course of repeated productions of images.

Further, since the silica particle have not required particle size distribution, for example upon cleaning with the cleaning blade, upon transfer of a toner image produced on the photoreceptor to the transfer material, and upon separation of the transfer material by the use of a separation nail, they inclined to abrade, damage the surface of the photoreceptor and to cause defects or deterioration of the electrophotographic properties.

The present invention has been proposed in view of the above-mentioned state of the art, and the object of the present invention is, therefore, to provide a electrophotographic photoreceptor having high durability without causing abrasion or injury on the surface of the photoreceptor, without causing deterioration in the electrophotographic properties during the course of repeated production of images and capable of producing images with high density and sharpness.

Another object of the present invention is to provide an apparatus for electrophotography, wherein by the use of a cleaning blade as a cleaning means together with the above-mentioned photosensitive material under specific conditions, electrophotographic images with high density and sharpness are stably obtainable without causing abrasion or injury on the surface of the photosensitive material of the photoreceptor during the course of repeated reproduction of images.

Still another objective of the present invention is to provide a unit which is advantageously applicable to the above-mentioned electrophotographic apparatus, which is capable of being easily mounted on and removed from the main body of the above-mentioned electrophotographic apparatus and which is capable of producing electrophotographic images with high density and sharpness during the course of repeated reproduction of electrophotographic images for the long period of time.

SUMMARY OF THE INVENTION

The above-mentioned objects of the present invention can be achieved by an electrophotographic photoreceptor comprising a photosensitive layer on an photoconductive support, characterized in that said photosensitive comprises in its outermost surface layer silica particles wherein, the volume average particle size of the silica particles is 0.05 to 5 μm, and wherein either contains aluminium ingredient of not more than 1000 ppm, calcium ingredient of not more than 300 ppm and iron ingredient of not more than 1000 ppm, or contain none of these ingredients.

According to one preferable embodiment of the present invention, said silica particles substantially have a spherical shape and have been manufactured by a chemical flame CVD process.

According to another preferable embodiment of the present invention, it is preferable that the above-mentioned silica particles are treated with a hydrophobic treatment. According to still another preferable embodiment of the present invention, it is preferable that the outermost layer is a protective layer provided on a photosensitive layer and the silica particles are incorporated in this protective layer. According to still another preferable embodiment of the present invention, this protective layer may comprises a carrier transport substance(hereinafter referred to as CTL).

The above-mentioned object of the present invention can also be achieved by an electrophotographic apparatus which comprises (a) a photosensitive layer provided on an photoconductive support, said photosensitive material comprising in its outermost surface layer silica particles, the volume average particle size of silica particles is 0.05 to 5 μm, and which either containing aluminium ingredient of not more than 1000 ppm, calcium ingredient of not more than 300 ppm and iron ingredient of not more than 1000 ppm, or none of these ingredients;
(b) a means for forming an electrostatic latent image on the photosensitive material:
(c) a means for developing said electrostatic latent image to be a toner image;
(d) a means for transferring said toner image formed on the photosensitive material on a transfer material; and
(e) a means for cleaning residual toner remained on the photoreceptor transfer material.

According to still another preferable embodiment of the present invention, cleaning is carried out by bringing said cleaning blade of the cleaning means into pressure contact with said photoreceptor with a pressure-contact force of 5 to 50 g/cm against moving direction of the photoreceptor.

Still further, the above-mentioned objects of the present invention are achieved by an electro-photographic image forming apparatus unit comprising at least two selected from the group consisiting of a photoreceptor, an electrification means, a developing means, a transferring means, a de-electrification means and a cleaning means, wherein said photoreceptor and at least one of the electrification means, the developing means, the transferring means and the cleaning means are installed together in the unit, and further, ther are capable of being easily and freely mounted on and removed from the unit, and wherein the photoreceptor comprises in its outermost surface layer silica particles wherein the volume average particle size of the silica particles is 0.05 to 5 μm, and wherein said silica particle either contains an aluminium ingredient of not more than 1000 ppm, a calcium ingredient of not more than 300 ppm and an iron ingredient of not more than 1000 ppm.

According to still another preferable embodiment of the present invention, a resilient cleaning blade is used as a cleaning means and at least said cleaning blade and said photosensitive material are supported as one body and are installed so that it is capable of being easily and freely mounted on and removed from said main body.

In the present invention, it is preferable that the outermost layer of the electrophotographic receptor comprises inorganic fine particles having a specific volume resistivity of more than 1010 Ω·cm, the volume average particle size of 0.02 through 5 μm and a polyarylate resin.

The polyarylate resin is preferably represented by Formula V.

Formula V

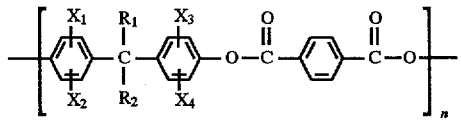

wherein, $R_1$, $R_2$, $X_1$, $X_2$, $X_3$ and $X_4$ each represent a hydrogen atom, an alkyl group, an alkoxy group, an aryl group, an amino group, a carbamoyl group, a sulfamoyl group, or an acyl group; n represents an integer of 20 to 100.

The polyarylate resin is preferable contained in an amount of 1 to 200% by weight of the silica particles contained in the outermost layer.

The silica particles are preferably treated with a silane coupling agent represented by Formula 1.

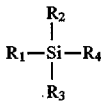

wherein $R_1$ represents a halogen atom, an alkyl group, an alkenyl group, a cycloalkyl group, an aryl group, an alkyloxy group, an alkenyloxy group, a cycloalkyloxy group, an aryloxy group, an acyl group or an acyloxy group, provided that these groups may have a substituent; $R_2$ through $R_4$ each represent a halogen atom, an alkyl group, or an alkoxy group.

The silica particles of the present invention has as an essential requirement that the heat-absorption energy difference (ΔH) is 0 to 20 Joule/g at a temperature range of 40° to 200° C. measured by differential scanning colorimeter at between 40° and 200° C., and it is preferable that the heat-absorption energy difference (ΔH) is 0 to 10 Joule/g at a temperature range of 40° to 200° C.

Since the electrophotographic photoreceptor employing the silica grains has slightly adsorbed a gaseous molecule and, particularly, water molecule, it is capable of producing an excellent electrostatic image under high humidity conditions and has excellent potential stability during repeated use.

Measurement of ΔH in the present invention is most preferably carried out under the condition of 80% of relative humidity, and, thereafter measured with differential scanning colorimeter (DSC) under the same condition.

However, in the case off the actual analysis, when the silica particles are stored under the condition of 80% of relative humidity for about 24 hours, and then, the measurement is conducted within 60 minutes, a constant analytical result can be always obtained.

The above-mentioned object of the present invention can also be achieved by an electrophotographic apparatus comprising (a) a photoreceptor,
(b) a means for forming an electrostatic latent image on the photoreceptor, (c) a means for developing said electrostatic latent image to form a toner image on the photoreceptor;

(d) a means for transferring the toner image formed on the photoreceptor on a recording sheet; and (e) a means for cleaning residual toner remained on the photoreceptor, wherein an elastic blade employed as the cleaning means.

According to still another preferable embodiment of the present invention, cleaning is carried out by contacting said cleaning blade of the cleaning means into pressure with said photo-receptor with a pressure-contact force of 5 to 50 g/cm against moving direction of the photoreceptor.

Schematic cross-sectional view of the photoreceptor according to the present invention.

[FIG. 2]

Schematic cross-sectional view of the image-forming apparatus according to the present invention.

FIGS. 3 to 8 are schematic cross sectional views of the photoreceptor of the invention.

Figure 9:
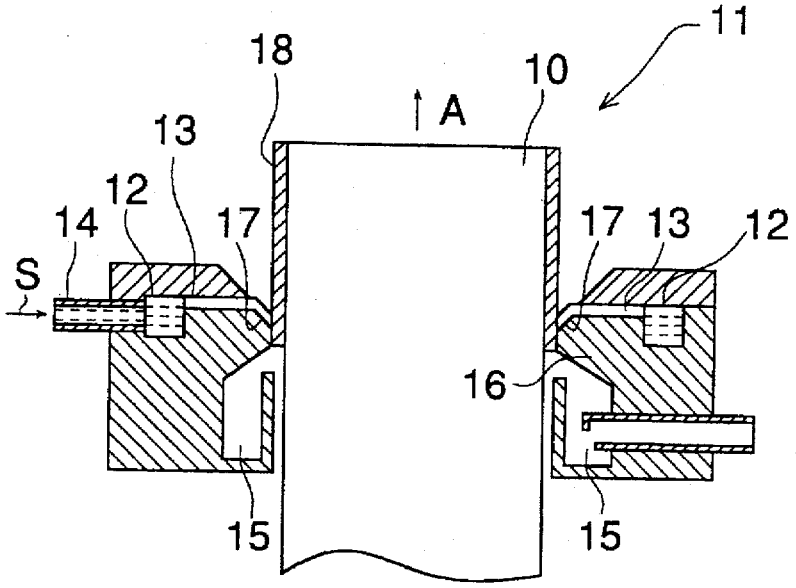
Figure 9:
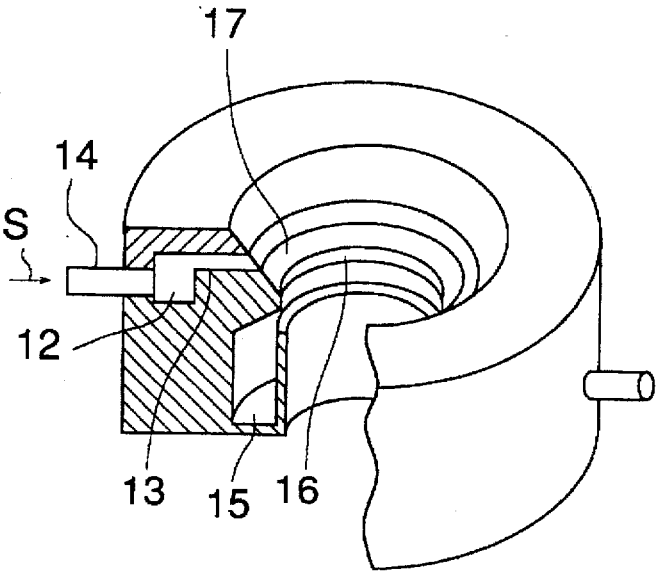

FIGS. 9(*a*) and 9(*b*) illustrate the circular slide hopper coating apparatus.

Figure 10:
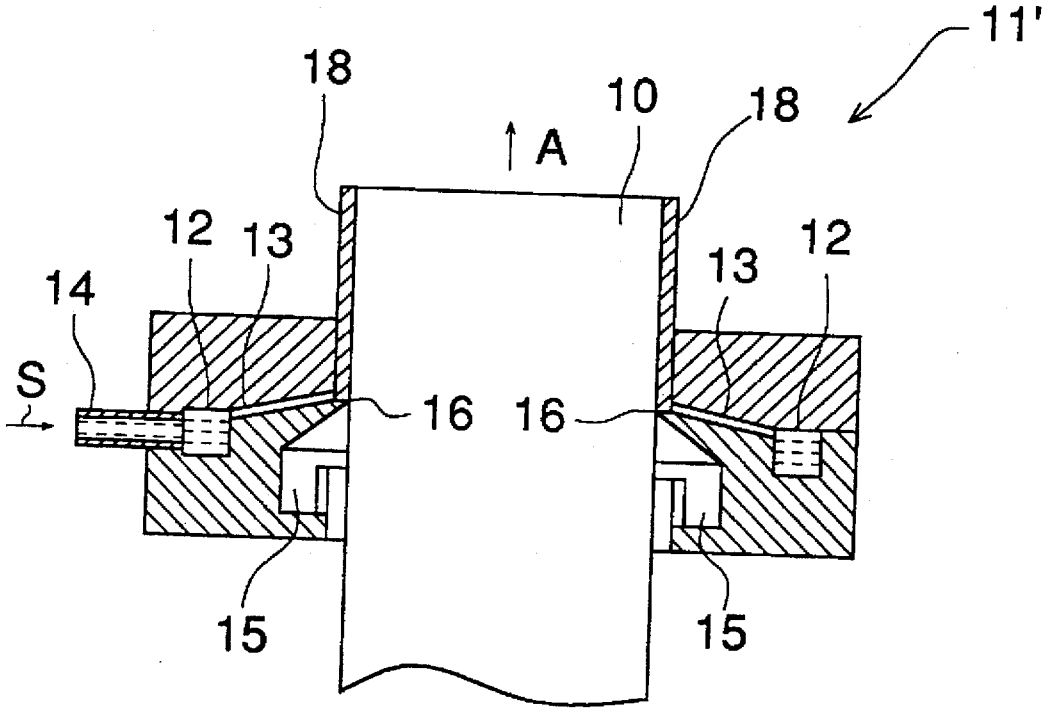

FIG. 10 illustrates the circular extrusion coating apparatus and

Figure 11:
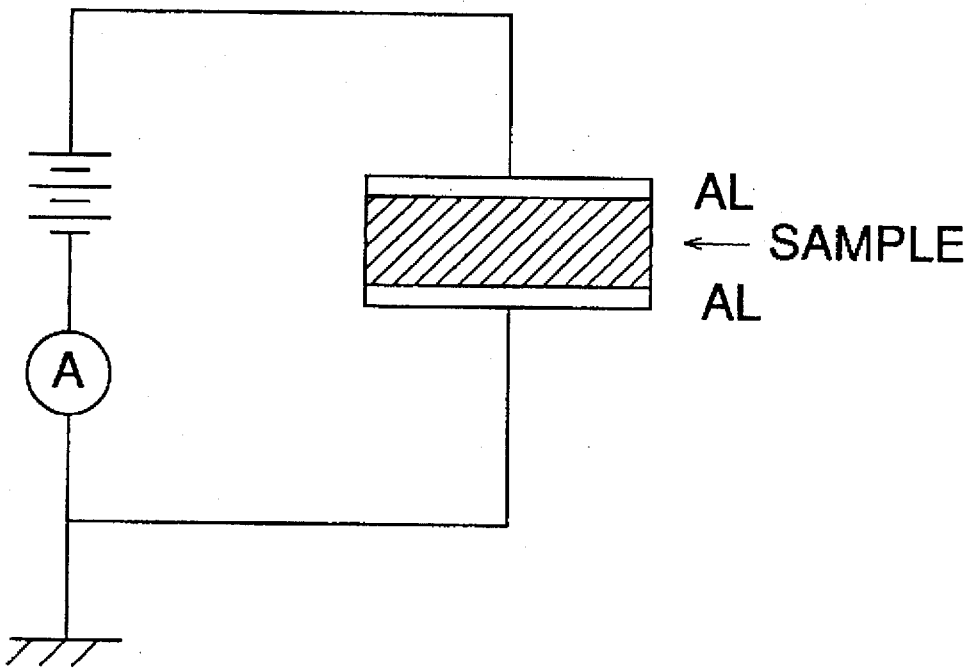

FIG. 11 shows the processing for measurement of a pellet having a 1 mm thickness.

[Explanation of numerals]

1. Electro-conductive substrate
2. Intermediate layer
3. Carrier transport layer ((CTL)
4. Carrier generation layer (CGL)
5. protective layer
6. photosensitive layer
10. Cylindrical conductive support
11. Circular slidehopper coater
12. Coating liquid distribution chamber
13. Coating liquid distribution slit
14. Coating liquid
15. Liquid receptor
16. Hopper edge
17. Slide grain
18. Coated layer
A. Direction
S. Coating liquid
11'. Circular extrusion coater

DETAILED DESCRIPTION OF THE INVENTION

The silica particles contained in the outermost layer of the photoreceptor according to the present invention either contain specific amount of iron, calcium, or aluminium, or contain none of these ingredients. The present invention has been completed by paying attention to these elemental ingredients contained in the silica particles, and the present invention has been accomplished by a finding that electrophotographic images with high density and sharpness are obtainable without causing fatigue and deterioration in the repeated image-formation is carried out for the long period of time.

The term "outermost surface layer" in the present invention is defined as a layer which constitutes the outermost surface when a photoreceptor is manufactured, and, for example, it may be a protective layer provided on a photosensitive layer, or when the photosensitive layer has no such protective layer, it may be a photosensitive layer which constitutes the outermost surface of the photoreceptor such as a carrier transport layer (hereinafter referred to as CTL) and, among then, a carrier transport layer (CTL) is preferable. It is preferable that the above-mentioned outermost layer contains, in addition to the silica particles, a carrier transport material (CTM). The outermost surface layer of the present invention may be provided by dispersing silica particles according to the present invention, CTM which may be employed if necessary and other additives in an appropriate binder medium and provided by a coating means.

The silica particles according to the present invention contain iron, carcium and aluminium at a specific amount except for silica, or contain none of these elements. The silica particles which do not contain the above-mentioned specific elements, or which contain the above-mentioned elements but at the quantity outside the above-mentioned specific range are not preferable either because they exert the same effects as those containing the above-mentioned specific quantity or because it constitutes a factor of increasing cost and is not preferable.

In the silica particles of the present invention, it is preferable that iron is contained in an amount of 1 to 200 ppm, calcium is contained is an amount of 1 to 200 ppm, and aluminium is contained in an amount of 1 to 200 ppm.

When the silica particles contain preferable amounts of the above-mentioned elements, the improved results of the present invention can particularly be obtained.

When the amount of the above mentioned elements exceed the above-mentioned specific range, electrophotographic properties are degraded, the image density decreases and fog increases.

When the amount exceeds the above-mentioned specific preferable range, although the photoreceptor may be practically used, however, decrease in the image density graphic properties are degraded, the image density decreases and occurrence of fog may become more frequent. Further, when the amount does not reach the minimum value of the above-mentioned specific preferable range, difficulty in the manufacture may be accompanied and the manufacturing cost may be raised.

The silica particles of the present invention consist essentially of spherical-shaped particles, of which major axis/minor axis ratio is less than 2.0 and their volume average particle size is generally 0.05 to 5 μm and, more preferably, 0.1 to 2 μm. It is preferable that the particles have narrow particle size distribution.

When the volume average particle size is less than 0.05 μm, required mechanical strength on the surface of the photosensitive layer can not be obtained and it becomes more likely to be damaged by abrasion in the course of repeated reproduction of images. Further, when the volume average particle size is more than 5 μm, the surface roughness of the photosensitive layer become so large, so that insufficient cleaning takes place.

By the way, recently the high image quality has strongly been demanded in the field of electrophotography, and for this reason fine particle toner having the average particle size of less than 10 μm has employed popularity. In this case, in order that the sufficient cleaning effect to be exerted, control of the surface roughness of the photoreceptor becomes more important.

In the present invention, the silica particles are required to correspond the above-mentioned fine particle toner, so that it is preferable that the silica particle have a volume average particle size of 0.1 to 2 μm.

The above-mentioned silica particles have preferably a spherical shape and particularly, they are made into spheres, of which (major axis/minor axis) ratio is less than 2.0. Herein the term "spherical" means that the shape of the silica particles when magnified by 10,000 times does not have an irregular shape but is in a spherical shape. In that case it is possible to reduce frictional coefficient of the surface of the photosensitive layer, to bring an advantage that turning up of the cleaning blade may effectively be prevented. Further, the size distribution of the silica particles is preferably narrow, whereby mixing of large-on to the surface of the photoreceptor and occurrence of a film defect caused by coagulation of small size particles can effectively be prevented.

For the method of preparing the silica particles according to the present invention, a chemical flame CVD (CVD: Chemical valpor Deposition) method is preferable. In this method, first burning a mixed gas comprising oxygen and hydrogen or a mixed gas comprising hydrocarbon and oxygen to prepare a high temperature flame, and, therein, a reaction is taken place to manufacture an objected product. As an example, a method of obtaining silica particles by reacting a chlorosilane gas in a high temperature gas phase comprising the above-mentioned mixed gas, can be mentioned.

The silica particles used in the present invention is manufactured by the above-mentioned chemical flame CVD method, and, among of then, a method of putting metallic silica powder into the above-mentioned mixed gas and cause an explosive burning reaction therein is preferable.

This manufacturing method is explained in detail in, for example, Japanese Patent O.P.I. Publication Nos. 255602 (1985), 193908(1993), 193909(1993), 193928(19930, 196614(1993) and 107406(1994).

According to the manufacturing method disclosed in the above-mentioned respective references, a metallic silica material is washed for several times with highly purified water, to remove solubilizing ingredients, as well as to remove gas phase and thus to obtain highly purified fine powder of metallic silica. Next, form a flame for initiating combustion by introducing combustible gas such as LPG, etc to a burner portion in the head of the manufacturing apparatus and, then, initiate combustion by introducing a carrier gas such as air, which comprises the above-mentioned highly purified fine silica powder, scattered therein. Thereafter, supplying stepwise the above-mentioned combustible gas and the above-mentioned silica powder is explosively oxidized by combustion to obtain highly purified silica powder.

Next, as to the measurement of Resistivity of in organic fine particles such as the silica particles, the measurement is carried out as follows.

Measurement of Resistivity

Sample for measurement was processed to be a pellet having thickness of 1 mm as shown in FIG. 11. When measurement, shielding mechanism was assemble in order that the measurement is not affected by the surroundings, and the measurement and the measurement condition are as follows.

Power Source: High Voltage Constant Power Supply model S-1 (a product of Nagano Aichi Electric Co., Ltd.

Galvanometer: Keithley 610 C

2000 V of an electric potential is applied, after 1 minutes, the electric current is measured, so that Specific Volume resistivity (ρ) can be calculated by the following formulae:

$$R=\rho l/S$$

R: Resistance (calculated from R=V/I)

l=0.1 cm

S=1 $cm^2$

According to the above-mentioned manufacturing method, not only highly purified fine powder of silica with narrow grain size distribution may be obtainable, but also the above-mentioned grain size distribution may be widely varied depending on the objective.

Measurement the content of aluminium, calcium and iron in the above-mentioned silica particle can be made by flameless atomic absorption spectrometry with respect to the calcium ingredient and by ICP (Inductively coupled plasma) emission spectrometry with respect to iron and aluminium ingredients, respectively.

Further, the volume average particle size of the above-mentioned silica particles can be measured by the use of a laser diffraction or a scattering particle size distribution measuring apparatus LA-700 (produced by Horiba Manufacturing Co., Ltd.).

Next, the above-mentioned silica particles may preferably be made hydrophobic by the use of a hydrophobicity providing material such as a titan coupling agent, a silane coupling agent, a polymeric aliphatic acid or a metal salt thereof.

As for the above-mentioned titan coupling agent, for example, tetrabutyl titanate, tetraoctyl titanate, isopropyltriisostearoyl titanate, isopropyl-tridecylbenzenesulfonyl titanate and bis(dioctylpyrophosphate)oxyacetate titanate can be mentioned. Further for the silane coupling agent, for example, γ-(2-aminoethyl)aminopropyltrimethoxy silanate, γ-(2-aminoethyl)aminopropyltrimethoxy silanate, γ-(2-aminoethyl)aminopropylmethyldimethoxy silanate, γ-methacryloxypropyltrimethoxy silane hydro chloric acid salt, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane and p-methylphenyltrimethoxysilane can be mentioned.

The above-mentioned silica particles are preferably hydrophobic silica particles prepared by the use of a hydrophobicity providing material such as a titan coupling agent, a silane coupling agent, a polymeric aliphatic acid or a metal salt thereof.

1. Silane coupling agent

Although there's no specific limitation concerning silane coupling agent used in the present invention, the silane coupling agent represented by Formula 1 is preferably employed.

General Formula

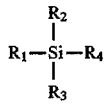

wherein $R_1$ represents a halogen atom, an alkyl group, an alkenyl group, a cycloalkyl group, an aryl group, an alkyloxy group, an alkenyloxy group, a cycloalkyloxy group, an aryloxy group, an acyl group or an acyloxy group, provided that these groups may have a substituent; $R_2$ through $R_4$ each represent a halogen atom, an alkyl group, or an alkoxy group.

As the alkyl group, those having 1 through 12 carbon atoms and, preferably, for example, a methyl group, an ethyl group, a propyl group, a butyl group, an octyl group or a dodecyl group can be mentioned.

As the cycloalkyl group, for example, a cyclopentyl group or a cyclohexyl group can be mentioned.

As the alkenyl group, for example, a vinyl group or an allyl group, and as the aryl group, for example, a phenyl group, a tolyl group or a naphthyl group can be mentioned, provided that these groups may have a substituent. As the substituent, for example, a halogen atom, an amino group, an alkyl group, an aryl group, an alkenyl group, an alkoxy group, an acyl group, an acyloxy group, an epoxy group or a mercapto group can be mentioned.

Specific examples of the silane coupling agents, which are preferably used in the present invention are given below.

1. $CH_2{=}CHSiCl_3$
2. $CH_2{=}CHSi(OCH_3)_3$
3. $CH_2{=}CHSi(OC_2H_5)_3$
4. $CH_2{=}CH(CH_2)_4Si(OCH_3)_3$
5. $CH_2{=}CH(CH_2)_8Si(OCH_3)_3$
6. $CH_2{=}CHO(CH_2)_3Si(OCH_3)_3$
7. $CH_2{=}CHOC(=O)(CH_2)_{10}Si(OCH_3)_3$
8. $CH_2{=}CHC(=O)O(CH_2)_3Si(OCH_3)_3$
9. $CH_2{=}CHC(=O)O(CH_2)_3Si(OCH_3)_2(CH_3)$
10. $CH_2{=}C(CH_3)C(=O)O(CH_2)_3Si(OCH_3)_3$
11. $CH_2{=}C(CH_3)C(=O)O(CH_2)_2O(CH_2)_3Si(OCH_3)_3$
12. $CH_2{=}CH$–C$_6$H$_4$–$Si(OCH_3)_3$
13. $CH_2{=}CH$–C$_6$H$_4$–$CH_2NH(CH_2)_2NH(CH_2)_3Si(OCH_3)_3.HCl$
14. $H_2N(CH_2)_3Si(OC_2H_5)_3$
15. $H_2N(CH_2)_3Si(OCH_3)_3$
16. $H_2N(CH_2)_2NH(CH_2)_3Si(OCH_3)_3$
17. $H_2N(CH_2)_2NH(CH_2)_3Si(OCH_3)_2(CH_3)$
18. C$_6$H$_4$–$NH(CH_2)_3Si(OCH_3)_3$
19. $CH_2$—$CHCH_2O(CH_2)_3Si(OCH_3)_3$ (epoxide)

-continued

20. C$_6$H$_{10}$O–$C_2H_4Si(OCH_3)_3$
21. $SH(CH_2)_3Si(OCH_3)_3$
22. $Cl(CH_2)_3Si(OCH_3)_3$
23. $CF_3(CF_2)_3CH_2CH_2Si(OCH_3)_3$
24. $HCF_2(CF_2)_4CH_2CH_2Si(OCH_3)_3$.
25. $CF_3(CF_2)_4CH_2CH_2Si(OCH_3)_3$
26. $CH_3Si(OCH_3)_3$
27. $C_2H_5Si(OCH_3)_3$
28. $C_3H_7Si(OCH_3)_3$
29. C$_6$H$_{11}$–$Si(OCH_3)_3$
30. $n\text{-}C_8H_{17}Si(OCH_3)_3$
31. $n\text{-}C_6H_{11}Si(OCH_3)_3$
32. C$_6$H$_5$–$Si(OCH_3)_3$
33. $CH_3$–C$_6$H$_4$–$Si(OCH_3)_3$
34. C$_6$H$_5$–$CH_2CH_2Si(OCH_3)_3$
35. C$_{10}$H$_7$–$Si(OCH_3)_3$ In addition to these silane coupling agents, for example, a polymer silane coupling agent represented by Formula III may also be used.

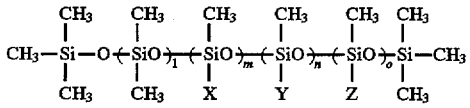

wherein X represents an alkoxysilyl group; Y represents a reactive organic functional group such as an epoxy group, a hydroxy group, an acryl group or a methacryl group; Z represent a compatibilizing unit with an organic group such as polyether, polyester and an aralkyl group. They are preferably ones which are compatible with a binder resin of a carrier transportation layer.

2. Titanium coupling agents

As the titanium coupling agents, titanium compounds having various chemical structures may be used. Specific examples are given below:

Isopropyl-triisostearoyl titanate,

Isopropyltris(dioctylpyrophosphate)titanate,

Isopropyltri(N-aminoethyl-aminoethyl)titanate,

Tetraoctylbis(ditridecylphosphite)titanate,

Tetra-(2,2-diallyloxymethyl-1-butyl)bis(didodecyl) phosphite titanate,

Bis(dioctylpyrophosphate)oxyacetate titanate,

Bis(dioctylpyrophosphate)ethylene titanate,

Isopropyltrioctanoyl titanate,

Isopropyldimethacrylisostearoyl titanate,

Isopropyltri(dodecylbenzenesulfonyl titanate,

Isopropylisostearoyldiacryl titanate,

Isopropyltri(dioctylphosphate)titanate,

Isopropyltricumylphenyl titanate

Tetraisopropylbis(dioctylphosphite)titanate,

3. Alminium coupling agent:

As the Alminium coupling agents, alminium compounds having various chemical structures may be used. Specific examples are given below:

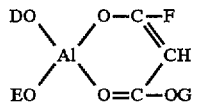

General Formula wherein D, E and F each represents an alkyl group having 1 to 6 carbon atoms, G represents an alkyl group having 1 to 24 carbon atoms or an alkenyl group having 1 to 24 carbon atoms. The alkyl group disclosed in D, E or F may nave a side chain, and, it is preferable that D and E each represents an isopropyl group and F represents a methyl group. The alkyl group or the alkenyl group disclosed in D may have a side chain, and it is preferable that D is an alkyl group or an alkenyl group having a carbon number of 8 to 24.

These coupling agents may be incorporated in the binder resin, however, it is preferable that the surface of the silica particles is treated with these coupling agents in advance of use. By this, affinity between the surface of the silica particles and the binder resin is enhanced, and improvement in the dispersion property and adhesion property can be obtained.

The amount of the coupling agent is usually 0.1 to 100 parts by weight, and, preferably 0.5 to 10 parts by weight with respect to 100 parts by weight of the silica particles. Generally, sufficient hypothetical amount necessary to coat the surface of the particles can be calculated by the following formula. Herein, the hypothetical amount means the amount necessary to form a single molecular layer.

$$Ws=(Wf\times SE)/(MCA)$$

wherein Ws is an amount of silane coupling agent (g); Wf is an amount of particles used (g); SE: Specific surface area of the fine particles ($m^2/g$); MCA: Minimum coated area per 1 g of the silane coupling agent ($m^2/g$).

In practice, necessary processing amount depending on the purpose can be determined based on this value.

Since hydrophobic treatment conducted on the silica particles is usually carried out to form a single molecular layer or a thin layer being similar to that, the amount of impurities contained in the silica and the volume average diameter thereof can be assumed to be unchanged compared to the silica particles before the hydrophobic treatment.

The hydrophobic treatment of the silica particles can be attained by reacting silanol groups which are present on the surface of the silica particles with hydrophobic substances.

As the method of the hydrophobic treatment, for example, a method of reacting the silanol group with trimethyl chlorosilane under a high pressure condition (Kolloid-Z, 149,39 (1956), esterification with an alcohol (DBP 1074559), esterification in an autoclave (Bull. Chem. Soc. Japan, 49(12), 3389 (1976) are known in the art, however, particularly, a treatment with a silane coupling agent is popularly employed. As to the method of treatment by a silane coupling agent may be performed by, for example, the method disclosed in "Silane Coupling Agent" (published by Shinetsu Chemical Co., Ltd. and "Technical Data No. Z 003" (Published by Toshiba Silicone Co., Ltd.

In the present invention, these silica particles are incorporated together with a binder at least in the outermost layer of the electrophotographic photoreceptor. The ratio of the silica particles to the binder in the outermost layer is usually 1 to 200% by weight and, preferably, 5 to 100% by weight.

Further, as for the aliphatic acid and the metal salt thereof, for example, undecylic acid, lauric acid, tridecanic acid, myristic acid, palmitic acid, pentadecanoic acid, stearic acid, heptadecanoic acid, arachic acid, montanic acid, oleic acid, linorenic acid and arachidonic acid can be mentioned. As for the metal salt of these aliphatic acid, for example, salts of zinc, iron, magnesium, aluminium, calcium, sodium and lithium can be mentioned.

These compounds may be added and coated on the to the above-mentioned silica particles in an amount of 1 to 10% by weight and, more preferably 3 to 7% by weight of the silica particles. Further, these compounds can be used in combination.

Since hydrophobic treatment to be conferred on the above-mentioned silica particles is usually carried out with extremely thin layer, e.g., with a single molecular layer or so, the amount of impurities contained in the silica and the volume average diameter thereof can be assumed to be unchanged before and after the hydrophobic treatment.

The hydrophobic treatment of the silica particles can be attained by reacting silanol groups which are present on the surface the silica particles with hydrophobic substances.

For the method of the hydrophobic treatment, for example, a method of reacting the silanol group with trimethylchlorosilane under a high pressure condition (colloid-Z, 149,39(1956), esterification with an alcohol (DBP 1074559), esterification in an autoclave (Bull. Chem. Soc. Japan, 49(12), 3389(1976) are known in the art, however, particularly, a treatment with a silane coupling agent is popularly employed. As to the method of treatment by the use of a silane coupling agent may be performed by, for example, the method disclosed in "Silane Coupling Agent" (published by Shinetsu Chemical Co., Ltd. and "Technical Data No. Z 0032" (Published by Toshiba Silicone Co., Ltd.

In the present invention, these silica particles are incorporated together with a binder at least in the outermost layer of the electrophotographic photoreceptor. The content ratio of the silica particles to the binder in the outermost layer is usually 1 to 200% by weight and, preferably, 5 to 100% by weight.

The outermost layer according to the present invention may be either a photosensitive layer located in the uppermost position of the photoreceptor or a protective layer which is provided thereon.

The electro-photreceptor according to the present invention may be one, in which an in organic photosensitive material such as selenium, amorphous silicon or cadmium sulfide is used, however, preferably, it is an organic photoreceptor comprising an organic carrier generation material (hereinafter referred to as CGM) and a carrier transport material (hereinafter referred to as CTM).

Figure 1:
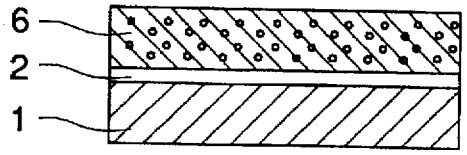
[FIG. 1]
Figure 1:
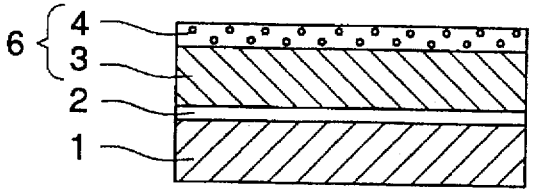
Figure 1:
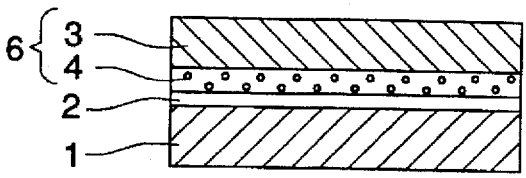
Figure 1:
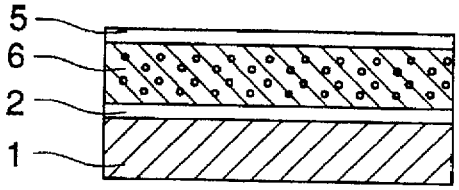
Figure 1:
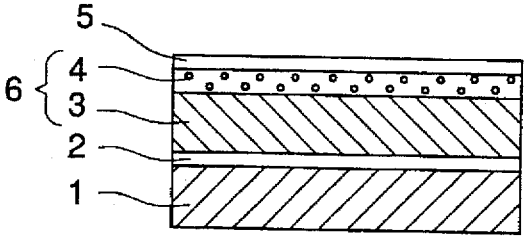
Figure 1:
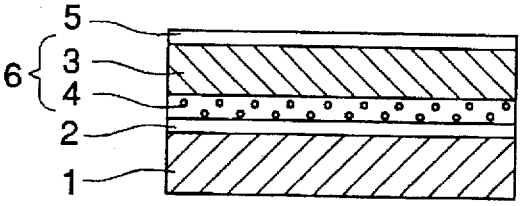

Schematic layer structure of the organic photoreceptor is shown in FIG. 1.

FIG. 1(*a*) shows a photoreceptor comprising an electro-conductive support 1 and provided thereon through an intermediate layer 2 a single photosensitive layer 6, which comprises both CGM and CTM. FIG. 1(*b*) shows another embodiment of the photoreceptor of the present invention, which comprises on an electro-conductive support 1, and, coated thereon through an intermediate layer 2, in this order a photosensitive layer 6 which consists of a carrier transport layer CTL 3 containing as CTM as the main ingredient, and a carrier generation layer CGL 4 containing CGM as the main ingredient, and FIG. 1(*c*) shows a still another embodiment of the photoreceptor of the present invention, which comprises on an electro-conductive support 1 and, coated thereon through an intermediate layer 2, a photosensitive layer 6 which consists of a CGL 4 and a CTL 3 in this order.

Further, FIGS. 1(*d*), 1(*e*) and 1(*f*) show still other embodiments of the photoreceptors of present invention, wherein a protective layer 5 is provided on the photosensitive layer of FIGS. 1(*a*), 1(*b*) and 1(*c*), respectively. FIGS. 1(*a*) through 1(*f*) illustrate representative layer structures of the photoreceptor of the present invention, however, the scope of the present invention is not limited by these examples. For example, in these drawings the intermediate layer 2 may be omitted if not absolutely necessary.

Among those layer structures mentioned above, as shown in FIGS. 1(*d*), 1(*e*) and 1(*f*), preferable embodiment is that the protective layer 5 is provided on the photosensitive layer and the silica particles of the present invention are incorporated in the protective layer 5.

The protective layer, when it is provided, comprises at least a resin and the silica particles of the present invention. It is preferable that the protective layer comprises CTM. By incorporating CTM in the protective layer, rise of the residual potential and desensitization of the electrophotographic photoreceptor in the repeated use can effectively be prevented.

As for the carrier Generation material (CGM) which is incorporated in the photosensitive layer 6 of the photoreceptor as shown in FIGS. 1(*a*) through 1(*f*), for example, phthalocyanine pigments, polycyclic quinone pigments, azo pigments, perylene pigments, indigo dyes, quinacridone pigments, azulenium pigments, squarylium dyes, cyanine dyes, pyrylium dyes, thiopyrylium dyes, xanthene dyes, triphenylmethane dyes, and styryl dyes can be mentioned. These CGM are used either singly or in combination with an appropriate binder to form a layer.

As for the CTM which is incorporated in the photosensitive layer 6, for example, oxazole derivatives, oxadiazole derivatives, thiazole derivatives, thiadiazole derivatives, triazole derivatives, imidazole derivatives, imidazolone derivatives, imidazoline derivatives, bis-imidazolidine derivatives, styryl compounds, hydrazone compounds, benzidine compounds, pyrazoline derivatives, stilbene compounds, amine derivatives, oxazolone derivatives, benzthiazole derivatives, benzimidazole derivatives, quinazoline derivatives, benzofuran derivatives, acridine derivatives, phenadine derivatives, aminostilbene derivatives, poly-N-vinylcarbazole, poly-1-vinyl pyrene, and poly-9-vinyl anthrathene can be mentioned, and these CTM are usually used together with a binder to form a layer.

Among those mentioned above, as particularly preferable CTM, a compound represented by Formula 1, 2, 3 or 4 can be mentioned.

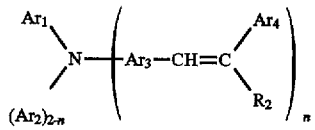

Formula 1 wherein $Ar_1$, $Ar_2$, $Ar_3$ and $Ar_4$ each represent an aromatic hydrocarbon group or heterocyclic group; R2 represents a hydrogen atom or an aromatic hydrocarbon group or heterocyclic group; n is 1 or 2; and $Ar_4$ and $R_2$ may combine each other;

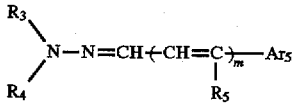

Formula 2 wherein $R_3$ and $R_4$ each represent an aromatic hydrocarbon group, heterocyclic group or alkyl group, which may combine one another; $R_5$ represent a hydrogen atom or an aromatic hydrocarbon group, heterocyclic group or alkyl group; $Ar_5$ represents an aromatic hydrocarbon group or heterocyclic group; and m is 0 or 1;

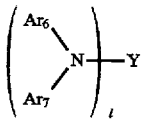

Formula 3 wherein Y represents a benzene, naphthalene, pyrene, fluorene, carbazole or 4,4'-alkylidene diphenyl group; $Ar_6$ and $Ar_7$ each represent an aromatic hydrocarbon group or heterocyclic group; and l represents an integer of 1 to 3.

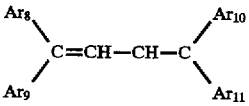

Formula 4 wherein $Ar_8$, $Ar_9$, $Ar_{10}$ and $Ar_{11}$ each represent an aromatic hydrocarbon group or heterocyclic group.

Among these, specific examples of the compounds which are preferably employed in the electro-photoreceptor of the present invention are shown below.

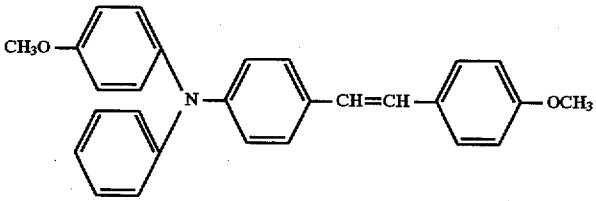

(T-1)

-continued
(T-2)
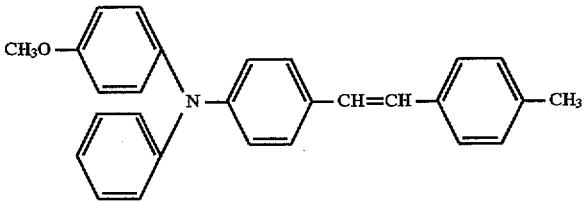
(T-3)
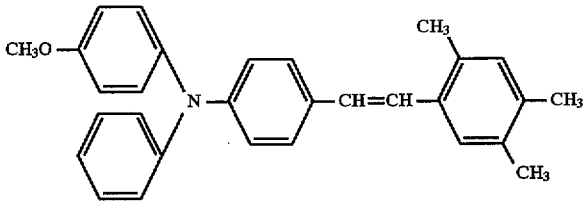
(T-4)
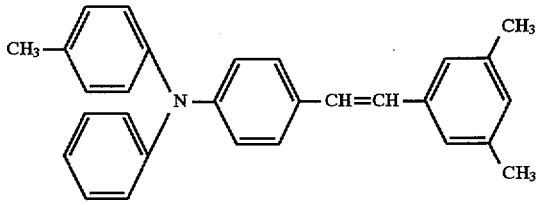
(T-5)
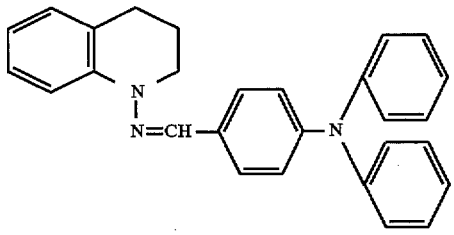
(T-6)
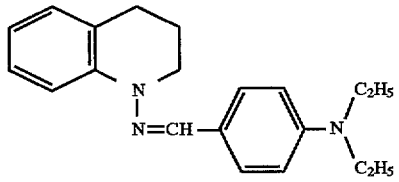
(T-7)
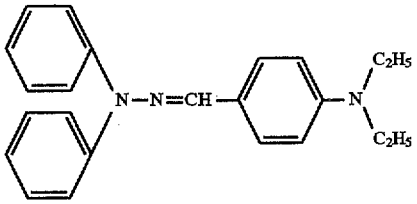
(T-8)
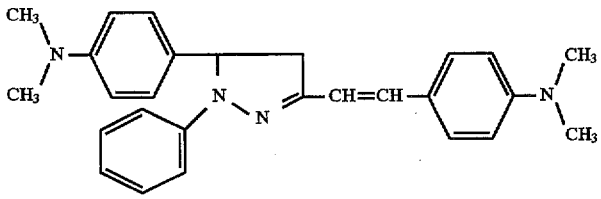

-continued
(T-9)
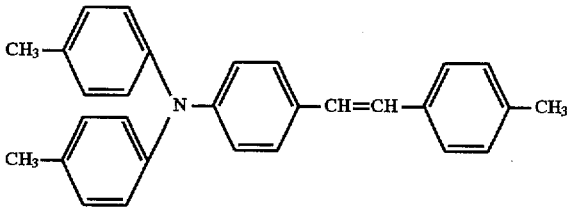
(T-10)
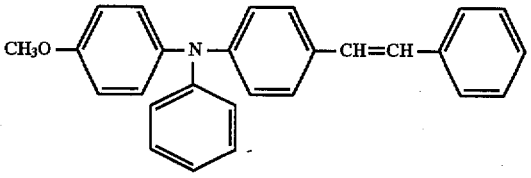
(T-11)
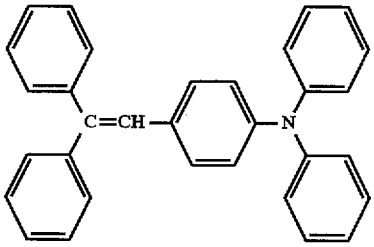
(T-12)
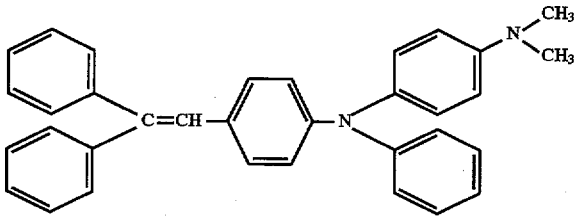
(T-13)
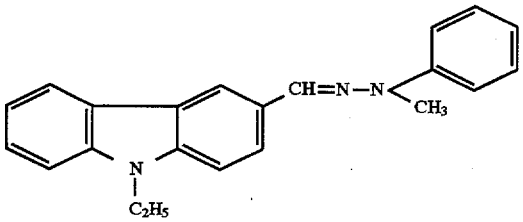
(T-14)
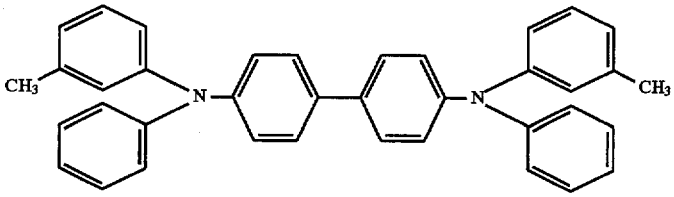
(T-15)
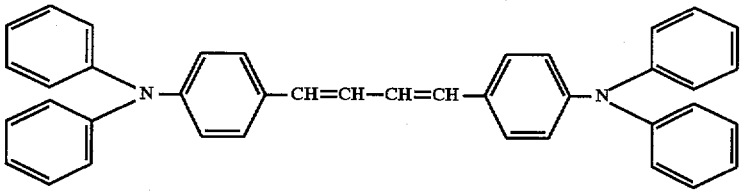

-continued
(T-16)
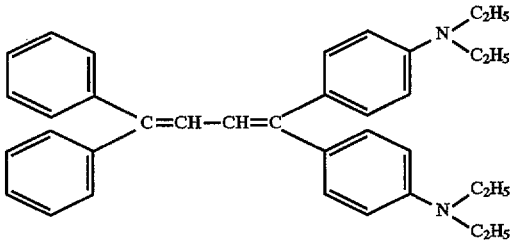
(T-17)
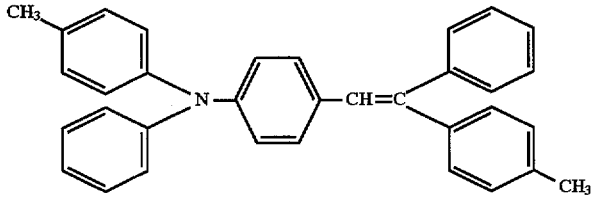
(T-18)
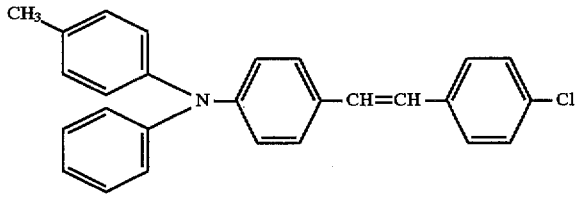
(T-19)
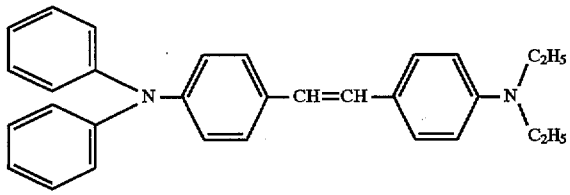
(T-20)
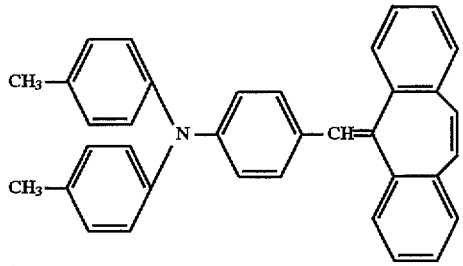
(T-21)
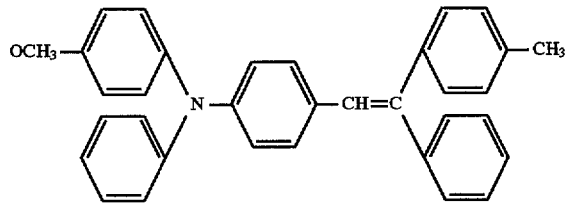
(T-22)
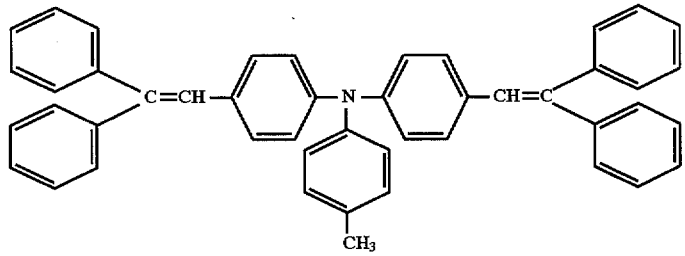

-continued
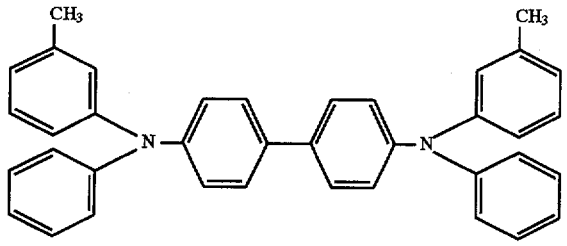
(T-23)
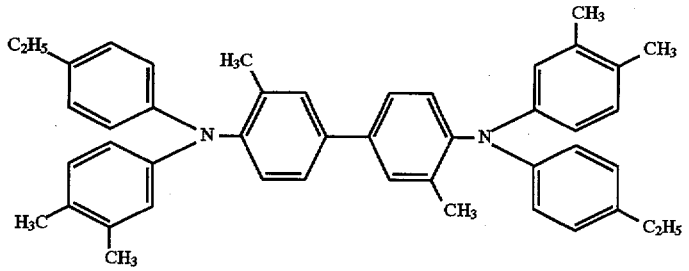
(T-24)
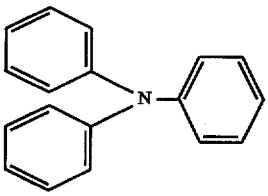
(T-25)
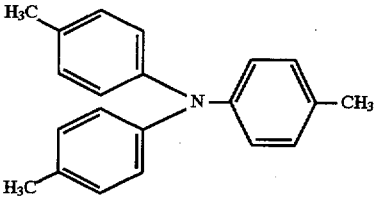
(T-26)
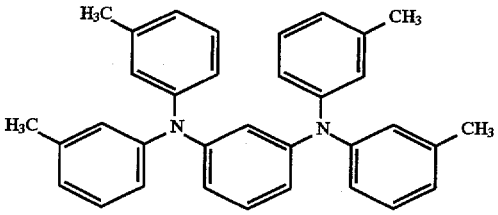
(T-27)
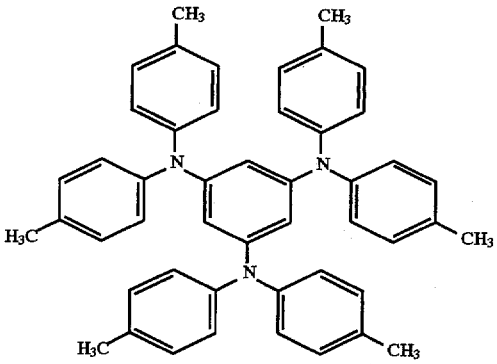
(T-28)

-continued (T-29)

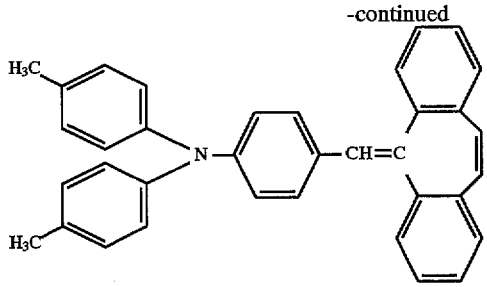

(T-30)

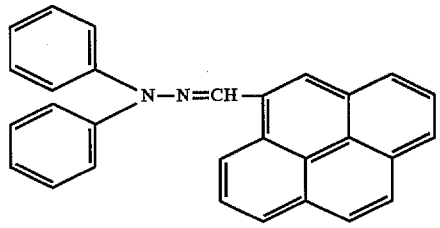

In the case of the photosensitive layer 6 having a single layer structure or multilayer structure, as for the binder resin used in the CGL or CTL mentioned above, for example, polyester resin, polystyrene resin, methacrylic resin, acrylic resin, polyvinyl chloride resin, poly vinylidene chloride resin, poly carbonate resin, polyvinyl butyral resin, polyvinyl acetate resin, styrene-butadiene resin, vinylidene chloride-acrilonitrile copolymer resin, vinyl chloride-maleic acid anhydride copolymer resin, urethane resin, silicone resin, epoxy resin, silicone-alkyd resin, phenol resin, polysilane resin and poly vinyl carbazole resin can be mentioned.

The binder resin incorporated in the uppermost layer of the photoreceptor as shown in FIGS. 1(*a*) through 1(*f*) preferably has strong resistance against mechanical impact and abrasion, without deteriorating photographic properties. As preferable binder resins, polycabonate resins represented by the Formulae (I) through (IV) can be mentioned.

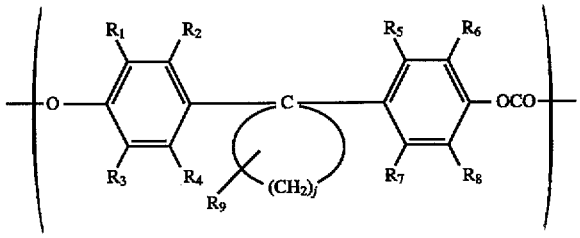

wherein $R_1$ through $R_8$ each represent a hydrogen atom, a halogen atom, an alkyl group having a carbon atom number of 1 through 10, a cycloalkyl group or aryl group j represents an integer of 4 through 11 and $R_9$ represents an alkyl group having carbon atom number of 1 through 9 or an aryl group.

Formula (II)

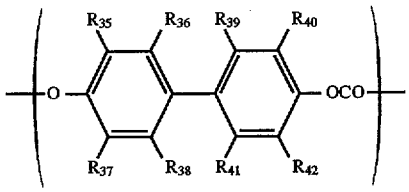

wherein $R_{35}$ through $R_{42}$ each represent a hydrogen atom, a halogen atom, an alkyl group or an aryl group.

Formula (III)

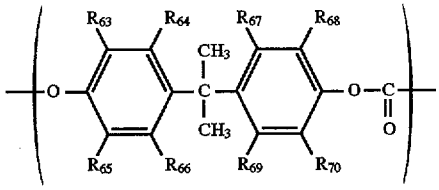

wherein $R_{63}$ through $R_{70}$ each represent a hydrogen atom, a halogen atom, an alkyl group having a carbon atom number of 1 to 10, a cycloalkyl group or aryl group.

Formula (IV)

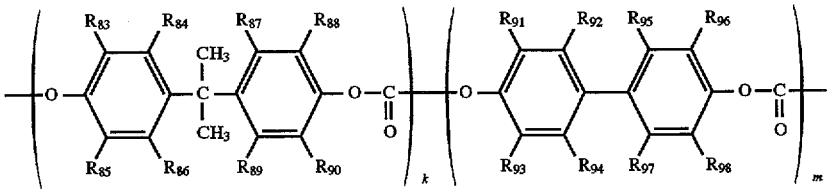

wherein $R_{83}$ through $R_{98}$ each represent a hydrogen atom, a halogen atom or an alkyl group or an aryl group; k sand m independently represent a positive integer, provided that k/m is 1 to 10.

The polycarbonate resins having the structure units represented by the above-mentioned general formulae preferably have weight average molecular weight of not less than 30,000.

Next, for a solvent or a dispersion medium used when the above-mentioned respective layers are formed, for example, n-butylamine, diethylamine, isopropanolamine, triethanolamine, triethylenediamine, N,N-dimethylformamide, acetone, methylethylketone, methylisopropyl ketone, cyclohexanone, benzene, toluene, xylene, chloroform, dichloromethane, 1.2-dichloroethane, 1,2-dichloropropane, 1,1,2-trichloroethane, 1,1,1-trichloroethane, trichloroethylene, tetrachloroethane, tetrahydrofurane, dioxane, methanol, ethanol, isopropanol, ethyl acetate, butyl acetate, dimethylsulfoxide and methyl cellosolve can be mentioned. However, the scope of the invention is by no means restricted to such specific examples. Further, these solvents may be used either singly or two or more kinds in combination.

When a ketone-type solvent is used sensitivity and potential fluctuation during repeated use further are improved.

In the present invention, proportion of the carrier generation substance and the binder resin is between 1:5 and 5:1 and, particularly, between 1:2 and 3:1 in terms of weight ratio is preferable. Further, thickness of the carrier generation layer is preferably not thicker than 5μ and, particularly between 0.05 and 2 μm is preferable.

The carrier transport layer can be formed by dispersing and dissolving the above-mentioned carrier generation substance and a binder resin in an appropriate solvent, and coating and drying this solution. Preferable mixing proportion of the carrier generation substance and the binder resin is usually between 3:1 and 1:3 by weight and, particularly, between 2:1 and 1:2.

Further, preferable thickness of the carrier transport layer is usually between 5 and 50 μm and, particularly, between 10 and 40 μm.

When the photoreceptor consists of a single layer, the photoreceptor can be obtained by coating a solution containing by dispersion or dissolution the above-mentioned carrier generation material, the carrier transport material and the binder resin and drying it.

When the outermost surface of the photoreceptor of the present invention is formed with a protective layer, said protective layer may be formed by dissolving and dispersing with the resin and the silica particles according to the present invention in a solvent, and thus obtained dispersion is coated on the surface of the photosensitive layer of the photoreceptor, and dried. In this case, it is preferable for the carrier transport material (CTM) to be incorporated in a protective layer. Preferable weight ratio of the resin and the CTM in the protective layer is, 3:1 to 1:3 and, particularly, preferably 2:1 to 1:2. Thickness of the protective layer is preferably 0.2 to 10 μm. When it is less than 0.2 μm, the advantage of the present invention is hardly obtained. When, on the other hand, it exceeds 10 μm, resolving power of the image will be deteriorated due to light scattering due to the silica particles in the protective layer. Further lowering of sensitivity and rising of residual potential may be accompanied. Thus, particularly preferable range is 0.4 to 5 μm.

Next, for the electro-conductive support used for the photoreceptor of the present invention, for example, 1) A metal plate such as an aluminium plate or a stainless steel plate;
2) A support comprising on a paper or plastic substrate a thin metal layer of aluminium, paradium or gold is provided by lamination or vapor-deposit; and
3) A support comprising on a paper or plastic support a electro conductive layer consisting of a electro-conductive compound such as a conductive polymer, indium oxide or tin oxide is provided by coating or evapor-deposit: can be mentioned.

Next, for the method of manufacturing the electrophotographic photoreceptor of the present invention, various conventional coating methods such as dip coating method, spray coating method and a circular slidehopper coater and a circular extrusion coater can be applied, however, in the view that the coating of the surface side of the photosensitive layer does not cause dissolution of the layer located thereunder, and that even coating is attainable, spray coating method or a circular slidehopper coater and a circular extrusion coater are preferably employed. For reference the above mentioned spray coating method is described in detail if, for example, in Japanese Patent O.P.I. Publication No. 3-90250(1991) and 269238(1991), and Japanese Patent O.P.I. Publication No. 58-189061(1983) discloses the above-mentioned a circular slidehopper coating and a circular extrusion coating method.

According to the above-mentioned spray coating or a circular slidehopper coating and a circular extrusion coating have advantages in comparison with the above-mentioned dip coating method, futile consumption of coating solution may be reduced and that uniform and even coating can be attained.

In the present invention, the circular slide hopper coater employed is shown in FIGS. 9(*a*) and 9(*b*) the circular extrusion coater is shown in FIG. 10.

In FIGS. 9(*a*), 9(*b*) and 10 is a cylindrical support that is transported in the direction of A, 11 is a circular slidehopper coater, 12 is the coating liquid distribution chamber of coater 11, 13 is a coating liquid distribution slit, 14 is a coating liquid supply pipe, 15 is a liquid receptor, 16 is a hopper edge, 17 is a coating liquid sliding plane and 18 is a coated layer. FIG. 9(*a*) is a cross-sectional view of coater 11 containing cylindrical support 10, and FIG. 9(*b*) is a partially sectional perspective view of the coater.

At the time of coating, a necessary amount of a coating liquid S is sent by a pump through a coating liquid supply pipe 14 to a coating liquid distribution chamber 12, from which the liquid is uniformly distributed in the circumferential direction to pass a distribution slit 13 and then uniformly stream down along a slide plane 17 in the circumferential direction. Afterward, coating liquid S is made in the bead form between a hopper edge 16 and the peripheral plane of support 10, and the support, with its peripheral plane being in contact with the bead, is transported in the direction of arrow A, and thus a coated layer 18 is formed. According to this coater, the solvent is quickly evaporated from coated layer 18, so that, if a simple drying means is provided, a dry layer can be easily obtained. Further, the coater supplies only a necessary amount of coating liquid S, so it causes no waste of the liquid and is helpful for cost reduction of the materials used. It is possible for the above coater to coat a uniform seamless layer because of a cirular coating type; to easily control the layer thickness because the thickness is determined according to the supply amount and viscosity of a liquid and the moving rate of the support to be coated; and to carry out a high-quality, highly productive coating since the coating thickness is stable due to the action of the bead during coating. In the above circular slidehopper coater, the gap between the slide plane terminal's diameter and the cylindrical support's external diameter is preferably 0.05 to 1 mm, and more preferably 0.1 to 0.6 mm. The slide plane's slant angle is preferably 10° to 70°, and more preferably 20° to 45° to a horizontal plane.

The viscosity of the coating liquid is preferably in the range of 0.5 to 700 Cp, and more preferably 1 to 500 Cp.

In the slidehopper coater, in order to cause the coating liquid to stream uniformly in the circumferential direction from the coating liquid distribution slit, the distribution chamber's resistance Pc and the slit resistance Ps when the liquid streams therethrough preferably have the relation of Ps/Pc being equal to or larger than 80, and more preferably being from 100 to 100,000.

Figure 5:
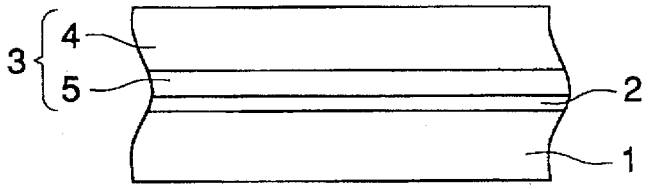
Figure 6:
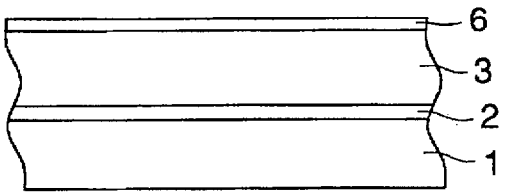
Figure 7:
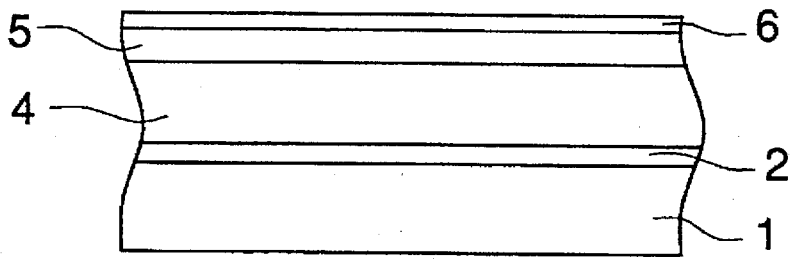
Figure 8:
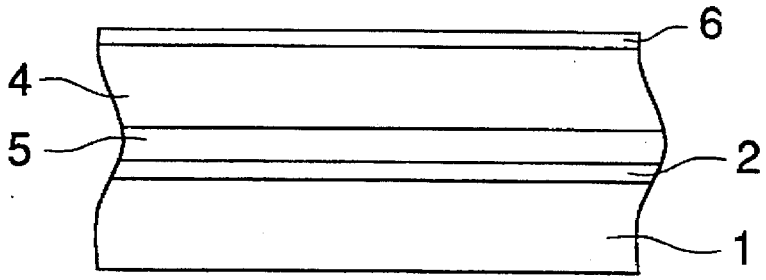

FIG. 10 is a cross-sectional view of a circular extrusion coater 11', in which the members identical with those of FIG. 5 are numbered likewise. In the circular extrusion coater, a necessary amount of a liquid S for coating is sent by a supply pump to a coating liquid supply pipe and uniformly distributed in the circumferential direction by a coating liquid distribution chamber 12, thereby to be extruded through a distribution slit 13, and then uniformly continuously streamed out from a hopper edge 16 for the coating liquid bead formation between the edge and the external surface of the cylindrical support, whereby a coated layer 18 is formed.

The length of the hopper edge is 0.1 to 10 mm, preferably 0.5 to 4 mm. The slant angle of the hopper edge is in the range of preferably up to 30°, more preferably up to 20° from perpendicularity. If the slant angle of the hopper edge exceeds 30°, then the cross-link of the coating liquid becomes shortened to make it difficult to obtain a satisfactory layer.

In the foregoing extrusion coater 11', the distribution chamber resistance Pc and the slit resistance Ps when the liquid streams through the distribution slit keep up the relation of Ps/Pc being equal to or larger than 40, more preferably from 40 to 100, whereby the liquid can be stably uniformly coated.

The distribution chamber resistance Pc and slit resistance Ps may be determined according to the coating liquid supply rate, viscosity and supply pressure. Further, in the coater 11', the hopper edge's diameter is 0.05 to 1 mm larger than the external diameter of the support, more preferably, if the layer thickness is expressed as ho mm, in the range of from 2 ho mm to 4 ho mm, and the coating direction length is 0.1 to 10 mm, preferably 0.5 to 4 mm.

In the present invention, a subbing layer, which functions as an adhesive resin and a barrier, may be provided between the electro-conductive substratum and the photosensitive layer.

For the material applicable as the intermediate layer, for example, casein, polyvinyl alcohol, nitro cellullose, ethylene-acrylic acid copolymer, polyvinyl butyral, phenol resin, polyamides such as nylon 6, nylon 66, nylon 610, nylon copolymer, alkoxymethylated nylon, etc., polyurethane, gelatin and aluminium oxide can be mentioned. Preferable thickness of the intermediate layer is usually between 0.1 and 10 μm and, particularly, between 0.1 and 5 μm.

Still further, in the present invention, it is also possible to provide a coating between the substratum and the subbing layer for the purpose of compensating defects of the support, or to provide a electro-conductive layer in order to prevent the occurrence of interference fringes. caused at the time of image in-put by laser beam. This electro-conductive layer can be formed by coating a solution of an adequate binding resin, in which electro-conductive particles such as carbon black, particles of a metal or a metal oxide is dispersed. Preferable thickness of the electro-conductive layer is between 0.5 and 40 μm and, particularly, 10 and 30 μm.

The above-mentioned respective layers can be coated by, for example, dipping method, a spray coating method, spinner coating method, bead coating method, blade coating method and beam coating method.

Further, the shape of the substratum may either be a belt-type or a sheet-type, and appropriate shape suitable for the electrophotographic apparatus to be used may be selected.

The image-carrying member according to the present invention may be applicable to electrophotographic apparatuses in general such as a copying machine, a laser printer, an LED printer and a liquid crystal-shutter type printer, etc., however, this is also applicable to other apparatuses for display, recording, photo printing, photolithography and facsimile, in which an electrophotographic technology is employed.

Figure 2:
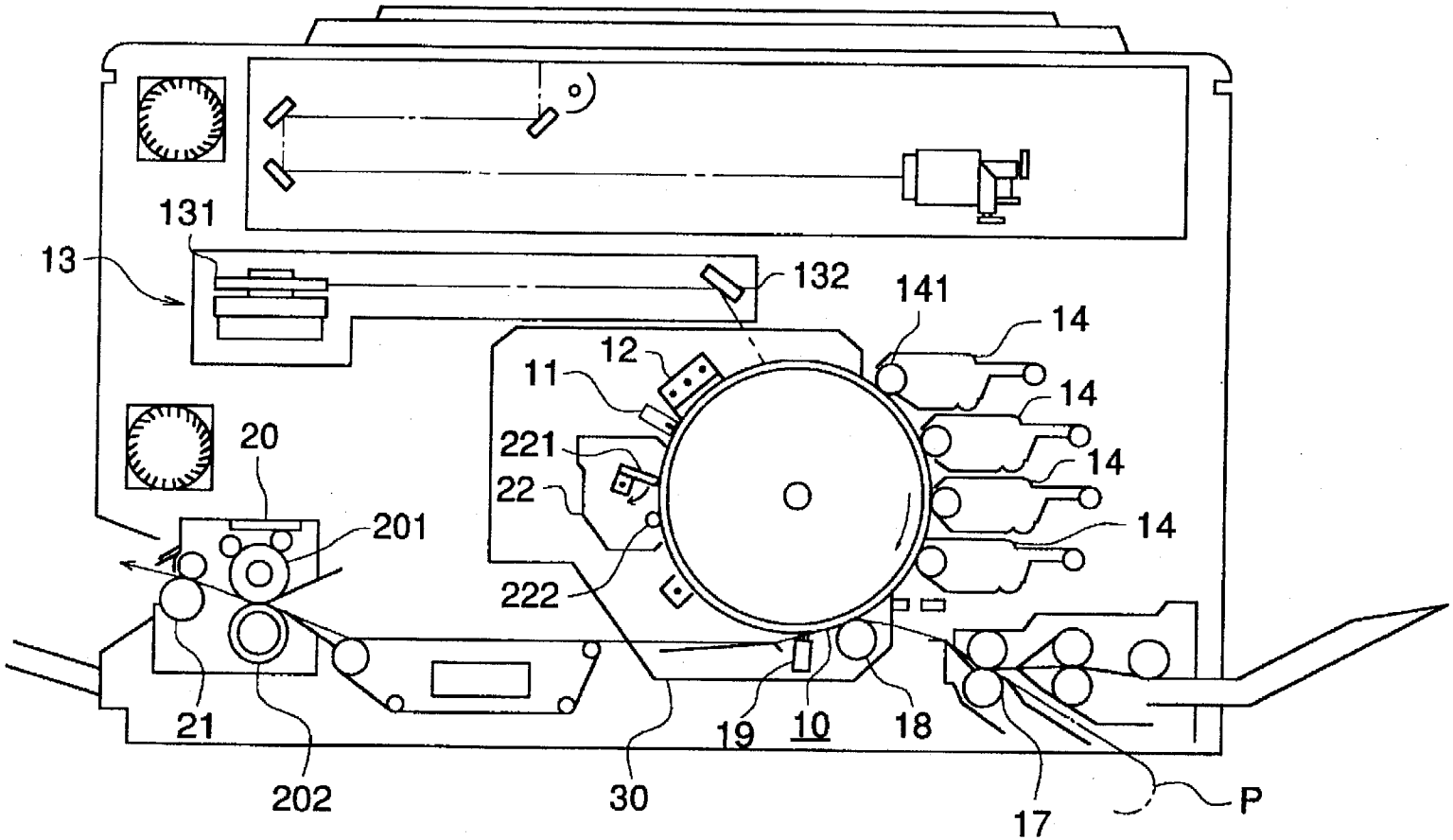
Figure 3:
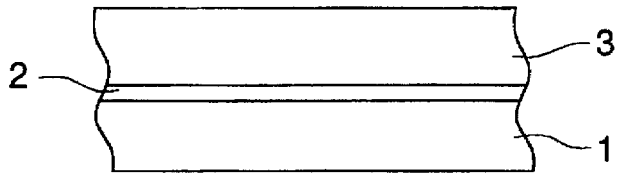
Figure 4:
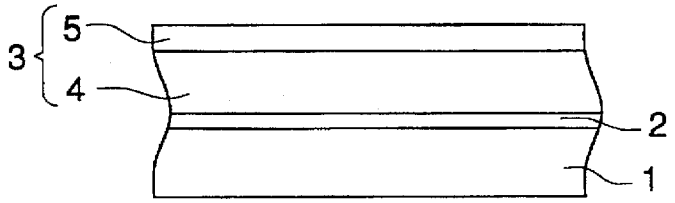

FIG. 2 illustrate a schematic exemplified structure of an image-forming apparatus.

In FIG. 2, a numeral 10 represents a photoreceptor drum, comprising an OPC photoreceptor coated on a drum, which is an image carrier and is rotarily driven clockwise. 12 represents a charger, by which uniform corona discharge is given on the peripheral surface of the photoreceptor drum 10. Prior to electrification by this charger 12, it is possible to carry out exposure by the use of PCL 11, in which a photo emissive diode, etc. is used, in order to diminish the background potential remained on the surface of the photoreceptor before the prior printing.

After uniform electrification, an imagewise exposure based on the image signal is performed by the use of an imagewise exposing means 13. In this figure, image exposure is carried out by scanning, the image-exposing means 13 is optionally selected from slit exposure, laser exposure, LED exposure, etc. depending upon its objective.

The electrostatic latent image is then developed with a developing device 14. Here, a plurality of developing units 14, which comprise developers consisting of carrier and three or different kinds of toners, i.e., yellow (Y), magenta (M), cyan (C) and black (K) toners, respectively, have been provided in the circumference of the photoreceptor drum 10. The developer consists of carrier particles consisting. In the development, first, development with the first color toner is carried out with a rotary development sleeve 141, which comprises built-in magnets and carries the developer. The developer usually consists of carrier particles made of ferrite core and an insulating resin coating provided thereon, and toner particles made of a polyester resin as the main ingredient and comprising a pigment, an electric charge-controlling agent silica and titanium oxide, etc., depending on the color to be produced. The developer is made into a 100 to 600-μm-layer on the development sleeve 141 by a layer-forming means and is transported to a region where development is performed. Development is carried out while applying direct or alternating biassing electric potential between photoreceptor drum 10 and the development sleeve 141.

In the formation of a color image, after the first development is completed a second image-formation (development) process, which comprises a step of uniform electrification by the use of a storocoron charger 12, a step of the second latent image formation of the second image data by the use of an exposing means 13 and the step of second development, is repeated. With respect to the third and the fourth colors, the same image-formation processes are repeated and, thus a color image consisting of four different color toners images is formed on the peripheral surface of the photoreceptor drum 10.

In the case of an electrophotographic apparatus for monochromatic image formation, on the other hand, the developing device 14 usually comprises only one (black) toner and the image can be formed by single development process.

A recording paper P is once stopped and, then, at the time when timing for transfer is in good synchronization, this is supplied to a transfer region by rotary movement of a sheet supplying roller 17.

In the transfer region, transfer roller 18 is brought into pressure contact with the peripheral surface of the photoreceptor drum 10 in oscillation with the timing for the image transfer, the recording sheet is put between the photoreceptor drum 10 and the transfer roller 18, and a multi-color image is transferred at one time to the recording sheet P.

Subsequently the recording sheet P is de-electrified by a separation brush 19, which was put into the state of pressure contact at almost the same time with the recording sheet P ands is separated from the circumference surface of the photoreceptor drum 10 and transported to a fixing unit 20, where the transferred image is fused and fixed on the recording sheet P by a heat roller 201 and a pressure roller 202. Then, the recording sheet P is discharged outside the apparatus through a delivering roller 18. At this time, the above-mentioned transfer roller 18 and the separation brush 19 are set apart from the circumference surface of the photoreceptor drum 10 and prepare for the following toner image formation.

On the other hand, the photoreceptor drum 10 which separated the recording paper P, residual toner particles are removed and the circumfential surface is cleaned by pressure contact of a blade 221 of the cleaning device 21, and, then, the drum is subjected to de-electrification with PCL 11 and uniform charging with a charger 12, to start the succeeding image-forming process. When a color image is imposed on the photoreceptor, the above-mentioned blade 221 is moved away from the circumference of the photoreceptor drum 10, immediately after completion of cleaning the surface of the photoreceptor.

Element 30 represents a removable cartridge having an electrophotographic image-forming apparatus an electrification means, a developing means and a cleaning means as one unit.

As the means for uniformly charging the photoreceptor drum 10, a corona discharging device is generally used. Also, a transfer roller 18 and a corona transferring means are popularly used. Among those above-mentioned constituent elements of an electrophotographic apparatus, including, for example, photoreceptor, developing means and a cleaning means, etc., a plurality of the means are assembled as a unit, which may be installed on the main body of an electrophotographic apparatus according to the present invention so that it is capable of mounting on and taking off freely from the main frame of the electrophotographic apparatus of the present invention. For example, a unit which comprises at least one selected from a charging means, a developing means and a cleaning means together with a photoreceptor, is assembled as one unit so that this unit is capable of mounting on and taking off freely from the main frame of the electrophotographic apparatus by the use of a rail fixed to the main frame of the apparatus. The above-mentioned charging means and/or developing unit may be incorporated in the apparatus unit.

In the case where the electrophotographic apparatus according to the present invention is used as a copying machine or a printer, image exposure operation may be carried out by irradiating transmitted or reflected photo from an original manuscript to the photoreceptor, or by reading it by the use of a sensor, encoding the recorded information into signals, driving laser beam, LED array or a liquid crystal shutter array, etc., thus to apply light to the photoreceptor.

In the case where the apparatus is used as a printer, the image exposing means 13 is an exposure to print out the received data.

EXAMPLES

The present invention is hereinbelow explained with reference to working examples, however, the scope of the present invention is not limited by them.

Example 1

<Preparation of silica particles>

Manufacturing example of silica particles 1

While supplying 3.0 ($N \cdot m^3/h$) of LPG as a combustible gas, and 90.0 ($N \cdot m^3/h$) of oxygen as an initial combustion-aiding gas, 7 ($N \cdot m^3/h$) of metallic silicon, which was dispersed in a carrier Gas consisting of air and comprises 21.5 ppm of alminium ingredient, 2.25 ppm of calcium ingredient and 10.8 ppm of iron ingredient, was supplied, to obtain silica particles. Impurities of the thus obtained silica particles were 10 ppm with respect to alminium and 1 ppm with respect to calcium, and average particle size and sphericality expressed in terms of major axis/minor axis ratio were 0.5 μm and 1.0, respectively. This was made to be Sample A1.

Manufacturing example 2 of silica particles

Silica particles were prepared in the same manner as in the manufacturing example 1, except that in this example, 100 ppm of metallic alminium, 20 ppm of calcium and 110 ppm of iron were incorporated in the metallic silicon. Impurity ingredients contained in the thus obtained silica particles, average diameter and the spericality (the ratio of major axis to minor axis) were 0.5 μm and 1.0, respectively. This was defined as Sample A2.

Manufacturing examples 3 through 12 of silica particles

Silica particles A3 through A12 were prepared in the same manner as in the manufacturing example 1, except that in these examples, amounts of alminium, calcium and iron to be incorporated in the metallic silicon and the density of the metallic silicon to be dispersed in the carrier gas were varied in order to adjust the amounts of impurities and the particle size. Amounts of impurities in the thus obtained silica particles A3 through A12 are shown in Table 1, together with those of A1 and A2. Sphericality of these particles were all 1.0.

TABLE 1

| | Impurities | | | Particle* size | ΔH |
|---|---|---|---|---|---|
| Sample No. | Al (ppm) | Ca (ppm) | Fe (ppm) | (μm) | (J/g) |
| Example A1 | 10 | 1 | 5 | 0.50 | 6.0 |
| Example A2 | 100 | 20 | 50 | 0.50 | 6.2 |
| Example A3 | 100 | 20 | 50 | 0.05 | 6.2 |
| Exmple A4 | 100 | 20 | 50 | 2.00 | 5.7 |
| Example A5 | 100 | 20 | 50 | 4.00 | 5.1 |
| Example A6 | 900 | 250 | 900 | 0.50 | 10.2 |
| Comparison A7 | 100 | 20 | 50 | 0.01 | 31.4 |
| Comparison A8 | 100 | 20 | 50 | 7.00 | 6.0 |
| Comparison A9 | 1200 | 350 | 1200 | 0.50 | 18.7 |
| Comparison A10 | 1200 | 20 | 50 | 0.50 | 16.1 |
| Comparison A11 | 1200 | 350 | 50 | 0.50 | 16.9 |
| Comparison A12 | 1200 | 20 | 1200 | 0.50 | 18.0 |

*A volume average particle size

<Preparation of photoreceptor 1>

On the circumference surface of a cylindrical drum made of alminium and having diameter of 80 mm, a polyamide resin intermediate layer having a thickness of 0.3 μm was provided. Next, on the intermediate layer, a CGL having a layer thickness of 0.3 μm was formed by coating (in dip coating method) a coating solution consisting of 30 parts by weight of CGM-1 represented by the following chemical structures, 10 parts by weight of butyral resin: Eslec B(BX-L, a product of Sekisui Kagaku Co., Ltd.) and 1600 parts by weight of methylethyl ketone was provided by dipping so that the dry thickness of this CGL was 0.3 μm.

Next, a 25 μm-thick CTL was formed by coating on the above-mentioned CGL a solution consisting of 500 parts of exemplified compound (T-1) as a CTM, 600 parts of polycarbonate resin "Yuupiron Z300" (a product of Mitsubishi Gas Kagaku Co., Ltd.) and 3000 parts of dichloromethane was coated by dip coating method on the above-mentioned CGL by the use of a circular slidehopper coater or a circular extrusion coater so that the dry thickness after drying to be 25 μm.

Moreover, a 1 μm-thick protective layer was formed by coating on the above-mentioned CTL a solution consisting of 50 parts of the above-mentioned exemplified compound (T-1) as a CTM, 100 parts of polycarbonate resin "Yuupiron Z300" (a product of Mitsubishi Gas Kagaku Co., Ltd.), which were dissolved in 2000 parts of dichloroethane, and to which 50 parts of silica particles A1 was added, was coated by dip coating method on the above-mentioned CTL by the use of a circular slidehopper coater or a circular extrusion coater so that the dry thickness after drying to be 1 μm, thus to prepare photoreceptor 1, according to the present invention.

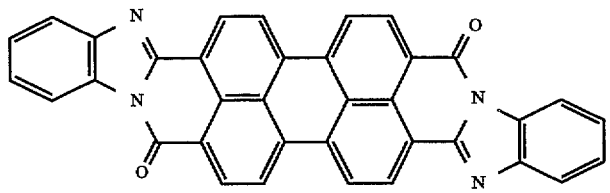

(1)

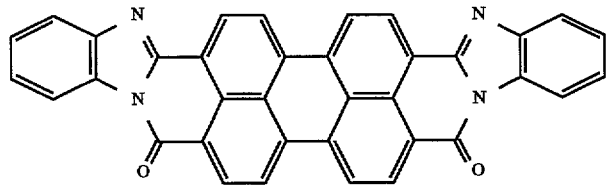

(2)

<Preparation of photoreceptors 2 through 6 according to the present invention and photoreceptors 1 through 6 for comparison>

Photoreceptors 2 through 6 in accordance with the present invention and photoreceptors 1 through 6 for comparison were prepared in the same manner as the photoreceptor 1, except that in these photoreceptors, instead of silica particle A1 as shown in Table 1, silica particles A2, A3, A4, A5 and A6, which are according to the present invention; and A7, A8, A9, A10, A11 and A12, which are for comparison were used respectively in the protective layer. Thus, photoreceptors 2 through 6 according to the present invention and photoreceptors 1 through 6 for comparison were prepared. Using the thus prepared 12 kinds of photoreceptors, durability test, in which respective photoreceptors were installed in an electrophotographic copying machine Konica U-BIX 4145 (a product of Konica Corporation) and copying procedures including electrification, exposure, development, transfer and cleaning processes were repeated for 50,000 times under the normal temperature and humidity conditions, i.e., at 20° C., 60% RH, measurement of abraded thickness of the photoreceptor, reversing of the cleaning blade and the image defects by insufficient cleaning were evaluated.

<Test of electro-static properties>

Using a modified copying machine, in which a surface potentiometer was arranged in place of the developing unit, above-mentioned copying procedures, i.e., electrification, imagewise exposure and de-electrification, were repeated for 50.000 times with respective photoreceptors, and black paper potential (Vb), white paper potential (Vw) and residual potential (Vr) for the first and the 50,000th times were measured. Results are shown in Table 1.

Herein, the black paper potential is defined as the surface potential when an imagewise exposure was carried out using a black paper original with a reflection density of 1.3; white paper potential is defined as the surface potential when the imagewise exposure was carried out using a original with a reflection density of 0.0.

<Image evaluation>

The above-mentioned 12 kinds of photoreceptors were respectively installed in the above-mentioned copying machine and 50,000 times picture duplication tests using a neutral gray original were carried out for each of the above-mentioned photoreceptors. During this experiment, occurrence of fogging due to insufficient cleaning and image damage due to reversing of the cleaning blade were evaluated.

<Reduction amount of thickness due to abrasion>

With respect randomly selected ten points in the respective photoreceptors, thickness of the evenly coated portion were measured and the average thickness was calculated by the use of a film thickness-measuring apparatus EDDY 560C (a product of ELMUT FISCHER GMBHT CO.). Measurements were carried out after completion of the first and the 50,000th copying operations and the thickness difference of is defines as reduction amount of thickness due to abrasion.

TABLE 2

| Embodiment | Silica Particles | Photoreceptor No. | Electrostatic Properties 1st copy Vb (−V) | Vw (−V) | Vr (−V) | 50,000th Copy Vb (−V) | Vw (−V) | Vr (−V) | Image Evaluation after 50,000th Copying (20° C., 60% RH) | Abraded Thickness of the Film (μm) |
|---|---|---|---|---|---|---|---|---|---|---|
| Example 1 | A1 | Photoreceptor-1 of the invention | 758 | 95 | 36 | 751 | 133 | 44 | Good | 0.32 |
| Example 2 | A2 | Photoreceptor-2 of the invention | 733 | 102 | 42 | 736 | 155 | 77 | Good | 0.30 |
| Example 3 | A3 | Photoreceptor-3 of the invention | 738 | 106 | 40 | 741 | 164 | 76 | Good | 0.45 |
| Example 4 | A4 | Photoreceptor-4 of the invention | 741 | 110 | 44 | 755 | 178 | 79 | Good | 0.31 |
| Example 5 | A5 | Photoreceptor-5 of the invention | 740 | 113 | 42 | 748 | 179 | 79 | Good | 0.34 |
| Example 6 | A6 | Photoreceptor-6 of the invention | 752 | 128 | 50 | 750 | 189 | 88 | Good | 0.33 |
| Comparison 1 | A7 | Photoreceptor-1 for Comparison | 740 | 124 | 25 | 758 | 183 | 110 | 1* | 1.58 |
| Comparison 2 | A8 | Photoreceptor-2 for Comparison | 739 | 125 | 51 | 744 | 187 | 95 | 2* | 0.47 |
| Comparison 3 | A9 | Photoreceptor-3 for Comparison | 698 | 245 | 128 | 740 | 441 | 325 | 3* | 0.36 |
| Comparison 4 | A10 | Photoreceptor-4 for Comparison | 730 | 140 | 130 | 730 | 250 | 220 | 4* | 0.40 |
| Comparison 5 | A11 | Photoreceptor-5 for Comparison | 730 | 135 | 130 | 720 | 200 | 187 | 4* | 0.37 |
| Comparison 6 | A12 | Photoreceptor-6 for Comparison | 727 | 130 | 127 | 730 | 210 | 200 | 4* | 0.38 |

1*: Reversing of the blade and scratches on the image occurred.
2*: Insufficient cleaning and fagging occurred.
3*: Great extent of fogging in the background occurred.
4*: Intermediate extent of fogging in the background occurred.

As obviously shown in the table, photoreceptors of the present invention have excellent properties in the electrostatic properties in the repeated copying operations, image evaluation and film thickness abrasion property.

On the contrary to the photoreceptors according to the present invention, in the Comparative photoreceptor 1, reversing of the blade took place and the amount of abraded film thickness was large. Insufficient cleaning occurred in Comparative photoreceptor 2 and with respect to comparative photoreceptors 3 through 6, in which silica particles containing large amount of impurities are used, electrostatic properties during repeated copying practice are deteriorated and fogging took place.

Example 2

Manufacture of photoreceptors 7 through 12 according to the present invention and photoreceptors 7 through 12 for comparison.

Silica particles A1 through A12 shown in Table 1 underwent hydrophobic treatment. These hydrophobic silica particles were made to be A13 through A24. For the hydrophobic treatment, hypothetical amount of trimethysilylmethoxysilane, $(CH_3)_3Si(OCH_3)$ was used.

Herein, the hypothetical amount means an amount necessary to form a single molecular layer on the surface of the particles and the amount can be calculated in the following numerical formula.

$$Ws = \frac{Wf \times SE}{MCA}$$

Wherein Ws represents added amount of silane coupling agent (g); Wf represents amount of fine particles used (g); SE represents: Specific surface area of the fine particles ($m^2/g$) and MCA represents minimum coated area ($m^2/g$) per 1 g of the silane coupling agent.

Photoreceptors 5 through 8 according to the present invention were prepared in the same manner as photoreceptors 1 through 6, except that in these photoreceptors, silica particles A1 through A6 used in the protective layer were replaced with hydrophobic silica particles A13 through A18, respectively.

Further, comparative photoreceptrors 7 through 12 were prepared in the same manner as photoreceptors 1 through 6, except that in these photoreceptors silica particle A7 through A12 used in the protective layer were replaced with hydrophobic silica particles A19 through A24, respectively.

These photoreceptors were respectively installed in the above-mentioned copying machine Konica U-BIX 4145 (a product of Konica Corporation) in the same manner as in Example 1 under 30° C., 80% RH conditions, and the same evaluations in Example 1 were conducted.

TABLE 3

| Embodiment | Silica Particles | Photoreceptor No. | Electrostatic Properties 1st copy Vb (−V) | Vw (−V) | Vr (−V) | 50,000th Copy Vb (−V) | Vw (−V) | Vr (−V) | Image Evaluation after 50,000th Copying (30° C., 80% RH) | Abraded Thickness of the Film (μm) |
|---|---|---|---|---|---|---|---|---|---|---|
| Example 7 | A13 | Photoreceptor-7 of the invention | 762 | 96 | 36 | 755 | 115 | 44 | Good | 0.30 |
| Example 8 | A14 | Photoreceptor-8 of the invention | 741 | 105 | 41 | 738 | 153 | 78 | Good | 0.29 |
| Example 9 | A15 | Photoreceptor-9 of the invention | 748 | 107 | 41 | 745 | 160 | 75 | Good | 0.42 |
| Example 10 | A16 | Photoreceptor-10 of the invention | 758 | 110 | 43 | 762 | 176 | 78 | Good | 0.30 |
| Example 11 | A17 | Photoreceptor-11 of the invention | 751 | 113 | 40 | 756 | 77 | 80 | Good | 0.32 |
| Example 12 | A18 | Photoreceptor-12 of the invention | 748 | 129 | 51 | 758 | 191 | 89 | Good | 0.32 |
| Comparison 7 | A19 | Photoreceptor-7 for Comparison | 745 | 133 | 62 | 756 | 198 | 119 | 1* | 1.40 |
| Comparison 8 | A20 | Photoreceptor-8 for Comparison | 740 | 135 | 59 | 751 | 194 | 100 | 2* | 0.44 |
| Comparison 9 | A21 | Photoreceptor-9 for Comparison | 714 | 288 | 154 | 738 | 564 | 404 | 3* | 0.35 |
| Comparison 10 | A22 | Photoreceptor-10 for Comparison | 730 | 170 | 100 | 730 | 280 | 190 | 4* | 0.37 |
| Comparison 11 | A23 | Photoreceptor-11 for Comparison | 720 | 180 | 98 | 730 | 220 | 185 | 4* | 0.35 |
| Comparison 12 | A24 | Photoreceptor-12 for Comparison | 710 | 175 | 70 | 715 | 205 | 180 | 4* | 0.36 |

1*: Reversing of the blade and scratches on the image occurred.
2*: Insufficient cleaning and fagging occurred.
3*: Great extent of fogging in the background occurred.
4*: Intermediate extent of fogging in the background occurred.

As obviously understood from Table 3, photoreceptors of the present invention have excellent properties in the electrostatic properties in the repeated copying operations, image evaluation and anti-film thickness abrasion property. On the contrary to the photoreceptors according to the present invention, in the Comparative photoreceptor 7, scratched image due to reversing of the cleaning blade took place and the amount of abraded film thickness was large. Further, fogging due to insufficient cleaning occurred in Comparative photoreceptor 8, and with respect to comparative photoreceptors 9 through 12 for comparison, fogging due to falling of sensitivity and rise of the residual potential took place.

Example 3

<Preparation of photoreceptors 13, 14 and 15 of the present invention>

These photoreceptors 13, 14 and 15 of the present invention were prepared in the same manner as photoreceptor 1 in Example 1, except

- that the diameter of the cylindrical alminium drum was changed from 80 mm to 100 mm;
- that the CGM contained in the CGL was changed from CGM-1 to oxytitanium phthalocyanine (CGM-2) having a maximum intensity peak at 2θ=27.3° in the Bragg angle (2θ±0.2°) and having at least one other peak at 9.5°, 9.7°, 11.6°, 15.0° or 24.1° as measured by X-ray diffraction under radiation of Cu—Kα rays.
- that the silica particles A1 used in the protective layer was replaced with A13; and
- that the thickness of the protective layer was replaced with 0.5 μm, 1.0 μm and 5.0 μm respectively.

The above-mentioned photoreceptors 13 through 15 are respectively installed in an electrophotographic color printer LP-7010 (a product of Konica Corporation), in which a photoreceptor drum, an electrode for electrification, an AC electrode for de-electrification, a cleaning blade, a recollection roller, and a PCL de-electrification before charging have been assembled as one unit, and wherein electrostatic image-forming procedure, including, electrification, exposure, development, image-transfer and cleaning steps are carried out for image-durability test by 100,000 times of repeated duplication of an image. For evaluation, amount of difference ΔVH (difference of potential in the white portion of the photoreceptor after first printing and that after 100,000th printing) and amount of difference ΔVL (difference of potential in the black portion of the photoreceptor after first printing and that after 100,000th printing) were measured. Further, occurrence of reversing of the cleaning blade and insufficient cleaning were also evaluated.

Chemical structure of CGM-2

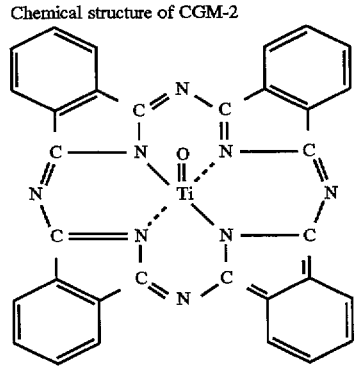

<Preparation of photoreceptors 13, 14 and 15 for comparison>Photoreceptors 13, 14 and 15 for comparison were prepared in the same manner as photoreceptors 13, 14 and 15 of the present invention, except that in these photoreceptors, silica particles used in the protective layer of the photoreceptors were replaced with silica particles A19, A20 and A21, respectively. Using the thus prepared photoreceptors, the same evaluation was carried out.

TABLE 4

| Embodiment | Silica Particles | Photoreceptor No. | Electrostatic Properties ΔVF | Electrostatic Properties ΔVL | Occurrence of Reversing of Cleaning Blade | Occurrence of Insufficient Cleaning |
|---|---|---|---|---|---|---|
| Example 13 | A13 | Photoreceptor-13 of the invention | 23 | 13 | No | No |
| Example 14 | A14 | Photoreceptor-14 of the invention | 28 | 12 | No | No |

TABLE 4-continued

| Embodiment | Silica Particles | Photoreceptor No. | Electrostatic Properties ΔVF | Electrostatic Properties ΔVL | Occurrence of Reversing of Cleaning Blade | Occurrence of Insufficient Cleaning |
|---|---|---|---|---|---|---|
| Example 15 | A15 | Photoreceptor-15 of the invention | 30 | 15 | No | No |
| Comparison 13 | A19 | Photoreceptor-13 for Comparison | 62 | 35 | Yes | No |
| Comparison 14 | A20 | Photoreceptor-14 for Comparison | 51 | 33 | No | Yes |
| Comparison 15 | A21 | Photoreceptor-15 for Comparison | 115 | 89 | No | No |

As apparent understood from Table 4, photoreceptors of the present invention are superior in the electrostatic properties, the repeated copying operations, reversing of the cleaning blade and in sufficient cleaning property. On the contrary to the photoreceptors of the present invention, in the Comparative photoreceptor 13, reversing of the cleaning blade took place, and as to photoreceptor 14 for comparison, insufficient cleaning took place and as to photoreceptor 15 for comparison, deterioration in the electrostatic properties was large compared with photoreceptors 13 through 15 of the present invention.

Example 4

<Preparation of photoreceptors 16 according to the present invention and Preparation of comparative photoreceptors 16>

An intermediate layer, CGL layer and CTL layer were prepared on an aluminium drum in the same manner as photoreceptor 1 of the present invention, except that in this photoreceptor 200 parts by weight of silica A13 was added to CTL of photoreceptor 1 of the present invention.

However, the protective layer was not provided on the CTL layer. Thus photoreceptor 16 of the present invention was prepared. Further, comparative photoreceptor 16 of was prepared in the same manner as photoreceptor 16 of the present invention, except that silica particles A13 was not added to the CTL layer.

These photoreceptors were respectively mounted on Konica U-BIX 4145 and the s me evaluation as in Example 1 was carried out.

TABLE 5

| Embodiment | Silica Particles | Photoreceptor No. | Electrostatic Properties 1st Copy Vb (−V) | 1st Copy Vw (−V) | 1st Copy Vr (−V) | 50,000th Copy Vb (−V) | 50,000th Copy Vw (−V) | 50,000th Copy Vr (−V) | Reversing of the cleaning blade | Reduction amount of thickness (μm) |
|---|---|---|---|---|---|---|---|---|---|---|
| Example 16 | A13 | Photoreceptor-16 of the invention | 755 | 101 | 38 | 751 | 118 | 47 | No | 0.32 |
| Comparison 16 | None | Photoreceptor-16 for Comparison | 754 | 99 | 38 | 750 | 123 | 48 | Yes | 1.24 |

As obviously understood from Table 5, the photoreceptor 16 of the present invention is superior to the photoreceptor 16 for comparison in all the following electrophotographic performance for example, electrostatic properties during repeated operation, reversing of the cleaning blade and anti-thickness reduction due to abrasion.

Example 5

<Preparation of silica particles>

Manufacturing Example 25 of silica particles

In accordance with the disclosure in Japanese Patent O.P.I. Publication No. 5-193908(1991), while supplying 3.5 ($N \cdot m^3/h$) of LPG as a combustible gas, and 10.0 ($N \cdot m^3/h$) of oxygen as an initial combustion-aiding gas is supplied, and 7 ($N \cdot m^3/h$) of dispersion material in which metallic silicon having an average particle size of 20 μm was dispersed in a proportion of 35 kg/h in a carrier gas consisting of ambient air, was supplied, so that silica particles were obtained.

When preparing the silica particles, the first, the second and the third flow rate of the combustion-aiding gas are 20, 30 and 40 ($N \cdot m^3/h$) respectively.

Thus obtained silica particles have an average particle size of 0.5 μm and a sphericalilty of 1.0 in terms of the ratio of the major axis to the minor axis.

The obtained silica particles were analyzed with Differential Scanning Calorimeter, so that a heat-absorption peak at a temperature range of 40° to 200° C. was observed.

This was defined as Sample A25.

[Measurement by differential scanning calorimeter]

Differential scanning calorimeter (herein (herein abbreviated to DSC) is a method of adding necessary energy to cancel the temperature difference between a sample and a standard sample, when the sample is heated at a constant heating rate and the standard sample is a thermally stable substance. According to the fact that a peak area of DSC is proportional to the amount of heat absorption, quantitative measurement of heat-absorption amounts can be carried out by the following formula.

$$M \times \Delta H = K \times A$$

Herein, m represents the mass of the sample; ΔH represents the amount of energy variation per mass unit of the sample; K represents the apparatus constant, and A represents the peak area. The silica particles were stored at the condition of a relative humidity of 80% for 24 hours for humidity adjustment.

Thereafter they were stored in a sealed container under the same conditions until DSC measurement, and said measurement was carried out within 60 minutes after the humidity adjustment.

In the present invention, the DSC measurement conditions are as follows:

| | |
|---|---|
| Apparatus: | Differential scanning calorimeter DSC-20 |
| Thermal controller: | SSC-580 (a product of Seiko Electric Co., Ltd.) |
| Measurement Conditions: | |
| Temperature range: | 35 to 300° C. |
| Rising rate of temperature: | 10° C./minute under the condition of 80% RH) |
| Surroundings: | Stationary ambient air surroundings |

<Manufacturing Example 26 of the silica particles>

Silica particles A26 through A33 were prepared in the same manner as Manufacturing example 25, except that density of the dispersed material was changed for the purpose of the particle size adjustment of the silica particle.

The average particle sizes of the obtained silica particles are shown in Table 6, and Sphericality of the silica particles was 1.0 with respect to all silica particles.

TABLE 6

| Silica Particles | Particle size (μm) | ΔH (J/G) Untreated | ΔH (J/G) After Hydrophobic Treatment |
|---|---|---|---|
| A25 | 0.2 | 7.7 | 4.6 |
| A26 | 0.5 | 6.2 | 3.1 |
| A27 | 1.0 | 5.9 | 3.0 |
| A28 | 0.05 | 12.8 | 8.0 |
| A29 | 3 | 5.7 | 3.0 |

TABLE 6-continued

| Silica Particles | Particle size (μm) | ΔH (J/G) Untreated | ΔH (J/G) After Hydrophobic Treatment |
|---|---|---|---|
| A30 Fumed silica (produced by Nippon Aerosil Co., Ltd.) | 0.03 | 28.2 | 20.9 |
| A31 Haipuresika (a product of Ube Nittoh Kasei co., Ltd.) | 0.2 | 219.5 | 86.3 |
| A32 Haipuresika (a product of Ube Nittoh Kasei co., Ltd.) | 0.5 | 194.7 | 72.4 |
| A33 OSCAL (a product of Shokubai Kasei Co., Ltd.) | 0.5 | 82.1 | 47.8 |

<Preparation of Photoreceptor 1>

On the circumference surface of a cylindrical drum made of alminium having diameter of 80 mm, a 0.3 μm thick intermediate layer consisting of a polyamide resin was provided. Next, on the intermediate layer, a 0.3 μm thick CGL was formed by coating (in dip coating method) a coating solution consisting of 30 parts by weight of CGM-1 represented by the following chemical structures, 10 parts by weight of butyral resin: Eslec B (BX-L, a product of Sekisui Kagaku Co., Ltd.) and 1600 parts by weight of methylethyl ketone was provided by dipping so that the dry thickness of this CGL was 0.3 μm.

Next, a solution consisting of 500 parts by weight of exemplified compound (T-1) as a CTM, 600 parts by weight of polycarbonate resin "Yupiron Z300" (a product of Mitsubishi Gas Kagaku Co., Ltd.) and 3000 parts by weight of dichloro methane was coated by dip coating method on the above-mentioned CGL, so that a 25 μm thick CTL was formed by coating on the above-mentioned CGL.

Furthermore, 50 parts by weight of the exemplified compound T-1 and 100 parts by weight of a polycarbonate resin "Yupiron Z800" (produced by Mitsubishi Gas Kagaku Co., Ltd.) are dissolved in 2000 parts by weight of dichloro ethane, and then, 50 parts by weight of the silica particle A-25 of Table 6 are mixed and dispersed in the mixture solution. Thus obtained coating solution was coated on the above-mentioned CTL layer with a circular slide hopper coater, so that a 1 μm dry thick protective layer was formed by coating on the CTL layer. Thus, Photoreceptor 1 of Example 5 can be obtained.

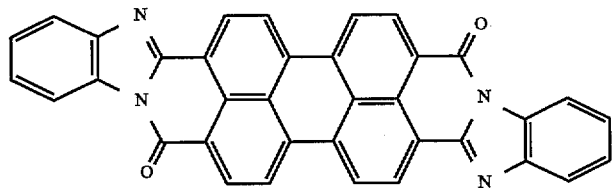

(1)

-continued

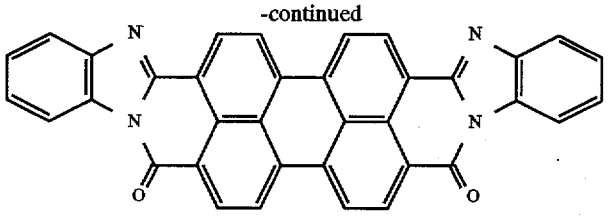

(2)

<Preparation of Photoreceptors 2 through 4 of the present invention and Photoreceptors 1 through 6 for comparison>

Photoreceptors 2 through 4 of the present invention and Photoreceptors 1 through 6 for comparison are prepared in the same manner as Photoreceptor 1 of Example 5, except that, instead of silica particle A25, silica particles A26, A27, A28 within the scope of the invention, and A29, A30, and A31, A32 and A33 without the scope of the invention were used respectively in the protective layer. Similarly, Photoreceptor 6 for comparison, in which the silica particles are not incorporated, was prepared.

Using the thus prepared 10 kinds of photoreceptors, durability test, in which respective photoreceptors were installed in a electrophotographic copying machine KONICA U-BIX 4145 (produced by Konica Corporation) and copying procedures including electrification, exposure, development, transfer and cleaning processes were repeated for 50,000 times under the condition of the high temperature and high humidity (30° C., 80% RH) conditions, measurement of abraded thickness of the photoreceptor, reversing of the cleaning blade and defects in the image by insufficient cleaning were evaluated.

<Test of electrostatic properties>

Using a modified copying machine, in which a surface potentiometer was arranged in place of the developing unit, above-mentioned copying procedures, i.e., electrification, imagewise exposure and de-electrification, were repeated for 50.000 times with respective photoreceptors, and black paper potential (Vb), white paper potential (Vw) and residual potential (Vr) for the first and the 50,000th times were measured. Results are shown in Table 7.

Herein, the black paper potential is defined as the surface potential when an imagewise exposure was carried out using a black paper original with a reflection density of 1.3; white paper potential is defined as the surface potential when the imagewise exposure was carried out using an original white paper with a reflection density is 0.0.

<Image evaluation.>

The above-mentioned 10 kinds of photoreceptors were respectively installed in the above-mentioned copying machine and 50,000 times picture duplication tests using a neutral gray original were carried out for each of the above-mentioned photoreceptors. During this experiment, occurrence of fogging due to insufficient cleaning and damages in the produced image due to reversing of the blade cleaning were evaluated.

<Reduction amount of thickness due to abrasion>

With respect randomly selected ten points in the respective photoreceptors, thickness of the evenly coated portion were measured and the average thickness was calculated by the use of a film thickness-measuring apparatus EDDY 560C (a product of ELMUT FISCHER GMBHT CO.). Measurements were carried out after completion of the first and the 50,000th copying operations and the thickness difference is defined as reduction amount of thickness due to the abrasion.

TABLE 7

| | | | Electrostatic Properties | | | | | | Image Evaluation | Abraded |
|---|---|---|---|---|---|---|---|---|---|---|
| | | | 1st copy | | | 50,000th Copy | | | after 50,000th | Thickness |
| Embodiment | Silica Particles | Photoreceptor No. | Vb (−V) | Vw (−V) | Vr (−V) | Vb (−V) | Vw (−V) | Vr (−V) | Copying (30° C., 80% RH) | of the Film (μm) |
| Example 1 | A25 | Photoreceptor-1 of the invention | 744 | 107 | 37 | 736 | 136 | 48 | Good | 0.35 |
| Example 2 | A26 | Photoreceptor-2 of the invention | 738 | 104 | 41 | 733 | 135 | 52 | Good | 0.32 |
| Example 3 | A27 | Photoreceptor-3 of the invention | 741 | 105 | 42 | 736 | 141 | 53 | Good | 0.29 |
| Example 4 | A28 | Photoreceptor-4 of the invention | 735 | 113 | 40 | 727 | 151 | 55 | Good | 0.41 |
| Comparison 1 | A29 | Photoreceptor-1 for Comparison | 745 | 115 | 45 | 730 | 163 | 72 | 1* | 0.30 |
| Comparison 2 | A30 | Photoreceptor-2 for Comparison | 728 | 124 | 51 | 736 | 188 | 116 | 2* | 1.24 |
| Comparison 3 | A31 | Photoreceptor-3 for Comparison | 733 | 103 | 39 | 741 | 224 | 146 | 3* | 0.88 |
| Comparison 4 | A32 | Photoreceptor-4 for Comparison | 738 | 108 | 41 | 744 | 256 | 167 | 3* | 0.74 |
| Comparison 5 | A33 | Photoreceptor-5 for Comparison | 741 | 110 | 44 | 752 | 269 | 188 | 3* | 0.69 |
| Comparison 6 | None | Photoreceptor-6 for Comparison | 740 | 110 | 36 | 715 | 135 | 48 | 4* | 1.58 |

1*: Insufficient cleaning occurred.
2*: Scratched image occurred.
3*: Fogging of the background occurred.
4*: Reversing of the cleaning blade took place.

As obviously shown in the table, photoreceptors of the present invention have excellent properties in the electrostatic properties in the repeated copying operations, image evaluation and anti-film thickness abrasion property.

On the contrary to the photoreceptors of the present invention, in the Comparative Photoreceptor 1, reversing of the blade took place and the amount of abraded film thickness was large. Insufficient cleaning occurred in Comparative Photoreceptor 2 and further, in Comparative Photoreceptors, in which silica particles A31, A32 and A33, containing large amount of impurities are used, electrostatic properties during repeated copying practice under high temperature and high humidity conditions were deteriorated and fogging took place.

Example 6

Manufacture of Photoreceptors 5 through 8 according to the present invention and Photoreceptors 7 through 12 for comparison.

Silica particles A25 through A33 shown in Table 6 were treated with hydrophobic treatment. These hydrophobic silica particles were set to be A110 through A118 respectively. For the hydrophobic treatment, hypothetical amount of trimethylsilylmethoxysilane $(CH_3)_3Si(OCH_3)$ was used.

Herein the hypothetical amount means the amount necessary to form a single molecular layer on the surface of the particles and was calculated according to the above-mentioned numerical formula.

Photoreceptors 5, 6, 7 and 8 according to the present invention were prepared in the same manner as Photoreceptor 1 through 4 Example 5, except that each silica particles A25 through A28 of the protective layer were replaced with hydrophobic silica particles A110 through A113 respectively.

Further, comparative photoreceptors 7 through 11 were prepared in the same manner as Photoreceptors 1 through 6 for comparison of Example 5, except that silica particles A29 through A33 used in the protective layer were replaced with hydrophobic silica particles A114 through A118, respectively.

These photoreceptors were respectively installed in the above-mentioned copying machine Konica U-BIX 4145 (produced by Konica Corporation) in the same manner as Example 5 under the condition of 30° C., 80% RH, and the same evaluations as in Example 5 were conducted.

TABLE 8

| | | | Electrostatic Properties | | | | | | Image Evaluation | Abraded |
|---|---|---|---|---|---|---|---|---|---|---|
| | | | 1st copy | | | 50,000th Copy | | | after 50,000th | Thickness |
| Embodiment | Silica Particles | Photoreceptor No. | Vb (−V) | Vw (−V) | Vr (−V) | Vb (−V) | Vw (−V) | Vr (−V) | Copying (30° C., 80% RH) | of the Film (μm) |
| Example 5 | A110 | Photoreceptor-5 of the invention | 738 | 108 | 38 | 730 | 128 | 47 | Good | 0.35 |
| Example 6 | A111 | Photoreceptor-6 of the invention | 740 | 106 | 40 | 732 | 127 | 49 | Good | 0.32 |
| Example 7 | A112 | Photoreceptor-7 of the invention | 743 | 107 | 43 | 736 | 129 | 50 | Good | 0.29 |
| Example 8 | A113 | Photoreceptor-8 of the invention | 733 | 111 | 41 | 730 | 133 | 52 | Good | 0.41 |
| Comparison 7 | A114 | Photoreceptor-7 for Comparison | 743 | 116 | 44 | 738 | 155 | 69 | 1* | 0.30 |
| Comparison 8 | A115 | Photoreceptor-8 for Comparison | 735 | 120 | 50 | 738 | 156 | 88 | 2* | 1.24 |
| Comparison 9 | A116 | Photoreceptor-9 for Comparison | 736 | 108 | 41 | 746 | 196 | 133 | 3* | 0.88 |
| Comparison 10 | A117 | Photoreceptor-10 for Comparison | 735 | 104 | 44 | 748 | 223 | 155 | 3* | 0.74 |
| Comparison 11 | A118 | Photoreceptor-11 for Comparison | 740 | 111 | 40 | 755 | 241 | 169 | 3* | 0.69 |

1*: Insufficient cleaning occurred.
2*: Scratched image occurred.
3*: Fogging of the background occurred.

As obviously understood from Table 8, photoreceptors according to the present invention have excellent properties in the electrostatic properties in the repeated copying operations, image evaluation and anti-film thickness abrasion property. On the contrary to the photoreceptors according to the present invention, in Comparative Photoreceptor 8, scratches in the image due to reversing of the blade took place and the amount of abraded film thickness was large. Further, fogging due to insufficient cleaning occurred in Comparative Photoreceptor 8, and with respect to comparative Photoreceptors 9 through 11 for comparison, fogging due to falling of sensitivity and rise of the residual potential took place.

Example 7

<Preparation of Photoreceptors 9, 10 and 11 according to the present invention>

These photoreceptors 9, 10 and 11 of the present invention were prepared in the same manner as photoreceptor 1 of Example 5, except that the diameter of the cylindrical alminium drum was changed from 80 mm to 100 mm;

that the CGM contained in the CGL was changed from CGM-1 to oxytitanium phthalocyanine (CGM-2) having a maximum intensity peak at $2\theta=27.3°$ in the Bragg angle (2θ±0.2°) and having at least one other peak at 9.5°, 9.7°, 11.6°, 15.0° or 24.1° as measured by X-ray diffraction under radiation of Cu—Kα rays.

that the silica particle A25 used in the protective layer was replaced with A110; and that the thickness of the protective layer was changed at 0.5 μm, 1.0 μm and 5.0 μm respectively.

The above-mentioned photoreceptors 9 through 11 were respectively installed in a color printer LP-7010 (produced by Konica Corporation), in which a photoconductive drum, an electrode for electrification, an AC electrode for de-electrification, a cleaning blade, a recollection roller, and a PCL (de-electrification before charging) have been assembled as one unit, and wherein electrostatic image-forming procedure, including, electrification, exposure, development, image-transfer and cleaning steps are carried out for image-durability test by 100,000 times of repeated duplication of an image. For evaluation, amount of difference ΔVH (difference of potential in the white solid portion of the photoreceptor after first printing and that after 100,000th printing) and amount of difference ΔVL (difference of potential in the black solid portion of the photoreceptor after first printing and that after 100,000th printing) were measured. Further, occurrence of reversing of the cleaning blade and insufficient cleaning were also evaluated.

Chemical structure of CGM-2

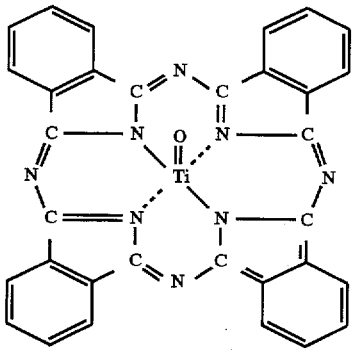

<Preparation of Photoreceptors 13, 14 and 15 for comparison>

Photoreceptors 13, 14 and 15 for comparison were prepared in the same manner as Photoreceptors 9, 10 and 11 of the present invention, except that silica particles used in the protective layer of the photoreceptors were replaced with silica particles A116.

Using the thus prepared photoreceptors, the photoreceptors 9, 10 and 11 of the invention and the photoreceptors 13, 14 and 15 for comparative were simultaneously evaluated.

TABLE 9

| Sample No. | Silica Particles | Photoreceptor No. | Electrostatic properties $\Delta V_H$ | $\Delta V_L$ |
|---|---|---|---|---|
| Inventive Sample 9 | A110 | Photoreceptor-9 of the invention | 31 | 18 |
| Inventive Sample 10 | A110 | Photoreceptor-10 of the invention | 36 | 16 |
| Inventive Sample 11 | A110 | Photoreceptor-11 of the invention | 42 | 21 |
| Comparison-13 | A116 | Photoreceptor-13 for comparison | 86 | 49 |
| Comparison-14 | A116 | Photoreceptor-14 for comparison | 74 | 51 |
| Comparison-15 | A116 | Photoreceptor-15 for comparison | 145 | 106 |

As obviously understood from Table 9, photoreceptors of the present invention are superior in the electrostatic properties in the repeated copying operations, reversing of the cleaning blade and in cleaning property. On the contrary to the photoreceptors of the present invention, in the Comparative Photoreceptors 13 through 15, deterioration in the electrostatic properties were large,

Example 8

<Preparation of Photoreceptors 12 of the present invention and Photoreceptors 19 for comparison>

Photoreceptor 12 was prepared by forming on an electroconductive drum thereon having an intermediate layer, a CGL and a CTL, in the same manner as photoreceptor 1 of Example 5, except that 200 parts by weight of silica particles A110 were added in CTL of Photoreceptor 1 of Example 5 of the present invention.

However, the protective layer was not provided on the CTL layer of the Photoreceptor 12. Thus photoreceptor 12 according to the present invention was prepared, Further, photoreceptor 16 for comparison was prepared in the same manner as Photoreceptor 12 of the present invention, except that silica particles A110 was not added in the CTL.

These photoreceptors were respectively mounted on Konica U-BIX 4145 and were evaluated by the same method disclosed in Example 5.

TABLE 10

| Embodiment | Silica Particles | Electrostatic Properties 1st Copy Vb (-V) | Vw (-V) | Vr (-V) | 50,000th Copy Vb (-V) | Vw (-V) | Vr (-V) | Reversing of the cleaning blade | Reduction amount of thickness (μm) |
|---|---|---|---|---|---|---|---|---|---|
| Example 12 | A110 | 738 | 111 | 36 | 732 | 137 | 48 | No | 0.35 |
| Comparison 16 | None | 740 | 110 | 36 | 715 | 135 | 48 | Yes | 1.58 |

As obviously understood from Table 10, the photoreceptor of the present invention is superior to the photoreceptor for comparison in every electrostatic properties such as during repeated operation, reversing of the cleaning blade and reduction of thickness due to abrasion.

What is claimed is:

1. An electrophotographic photoreceptor comprising a conductive support and provided thereon an intermediate layer, a carrier generation layer and a carrier transport layer, wherein an outermost layer of said electrophotographic photoreceptor contains silica particles each containing an aluminum ingredient of not more than 1000 ppm, a calcium ingredient of not more than 300 ppm and an iron ingredient of not more than 1000 ppm, and said silica particles have a volume average particle size of 0.05 through 5 μm, and said silica particles are stored under the condition having a relative humidity of 80%, and immediately, said silica particles are analyzed with a differential scanning calorimeter in a temperature range of 40° to 200° C., said silica particles show a heat-absorption energy variation amount (ΔH) of 0 to 20 Joule/g.

2. The electrophotographic photoreceptor of claim 1, wherein said heat-absorption energy variation amount (ΔH) of 0 to 10 Joule/g.

3. The electrophotographic photoreceptor of claim 1, wherein said silica particles are prepared by a Chemical Frame type CVD (chemical vapor deposition) method.

4. The electrophotographic photoreceptor of claim 1, wherein said silica particle is substantially a spherical particle.

5. The electrophotographic photoreceptor of claim 1, wherein said outermost layer is a protective layer.

6. The electrophotographic photoreceptor of claim 5, wherein said protective layer comprises a carrier transport material.

7. The electrophotographic photoreceptor of claim 1, wherein said silica particles are treated so as to have hydrophobicity with a hydrophobicity providing material.

8. The electrophotographic photoreceptor of claim 1, wherein said silica particles has a specific volume resistivity of more than $10^{10}$ Ω·cm.

9. The electrophotographic photoreceptor of claim 1, wherein said carrier transport layer comprises a compound selected from the group of consisting of Formulae 1, 2, 3 and 4:

Formula 1

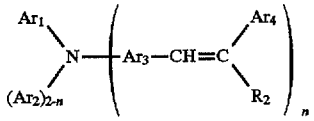

wherein $Ar_1$, $Ar_2$, $Ar_3$ and $Ar_4$ each is an aromatic hydrocarbon group or heterocyclic group; R2 is a hydrogen atom or an aromatic hydrocarbon group or heterocyclic group; n is 1 or 2; and $Ar_4$ and $R_2$ may combine each other;

Formula 2

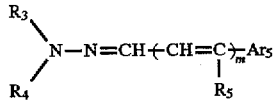

wherein $R_3$ and $R_4$ each is an aromatic hydrocarbon group, heterocyclic group or alkyl group, which may combine one another; $R_5$ is a hydrogen atom or an aromatic hydrocarbon group, heterocyclic group or alkyl group; $Ar_5$ is an aromatic hydrocarbon group or heterocyclic group; and m is 0 or 1;

Formula 3

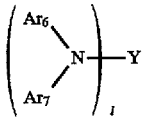

wherein Y is a benzene, naphthalene, pyrene, fluorene, carbazole or 4,4'-alkylidene diphenyl group; $Ar_6$ and $Ar_7$ each is an aromatic hydrocarbon group or heterocyclic group; and l is an integer of 1 to 3;

Formula 4

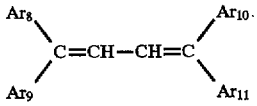

wherein $Ar_8$, $Ar_9$, $Ar_{10}$ and $Ar_{11}$ each is an aromatic hydrocarbon group or heterocyclic group.

10. The electrophotographic photoreceptor of claim 1, wherein said outermost layer comprises a binder, and a content ratio of said silica particles to said binder is 1 to 200% by weight of the binder.

11. The electrophotographic photoreceptor of claim 1, wherein said outermost layer comprises a binder, and a content ratio of said silica particles to said binder is 5 to 100% by weight of the binder.

12. The electrophotographic photoreceptor of claim 11, wherein said binder is a binder selected from the group consisting of Formulae I through V:

Formula I

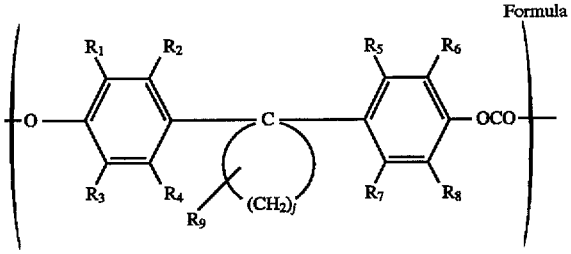

wherein $R_1$ through $R_8$ each is a hydrogen atom, a halogen atom, an alkyl group having a carbon atom number of 1 through 10, a cycloalkyl or an aryl group; j is an integer of 4 to 11 and $R_9$ is an alkyl group having a carbon atom number of 1 through 9 or an aryl group;

Formula II

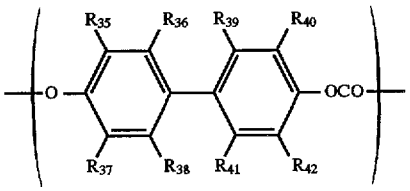

wherein $R_{35}$ through $R_{42}$ each is a hydrogen atom, a halogen atom, an alkyl group or an aryl group;

Formula III

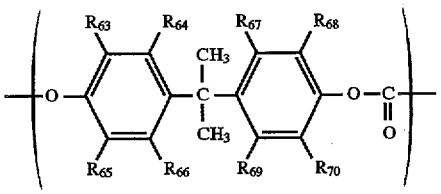

wherein $R_{63}$ through $R_{70}$ each is a hydrogen atom, a halogen atom, an alkyl group having a carbon atom number of 1 through 10, a cycloalkyl group or aryl group;

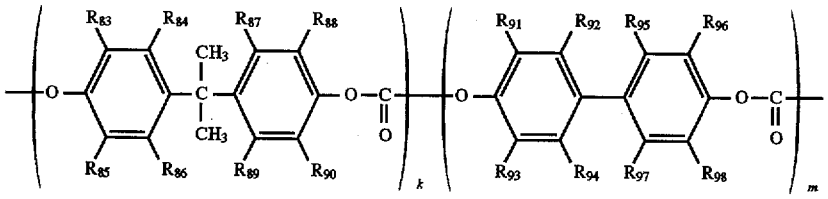

Formula IV wherein $R_{83}$ through $R_{98}$ each is a hydrogen atom, a halogen atom, an alkyl group or an aryl group; k and m independently are a positive integer, provided that k/m is 1 to 10;

Formula V

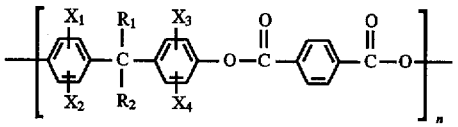

wherein, $R_1$, $R_2$, $X_1$, $X_2$, $X_3$ and $X_4$ each is a hydrogen atom, an alkyl group, an alkoxy group, an aryl group, an amino group, a carbamoyl group, a sulfamoyl group, or an acyl group; n is an integer of 20 to 100.

13. The electrophotographic photoreceptor of claim 7, wherein said hydrophobicity providing material is represented by Formula 1:

Formula 1

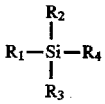

wherein $R_1$ is a halogen atom, an alkyl group, an alkenyl group, a cycloalkyl group, an aryl group, an alkyloxy group, an alkenyloxy group, a cycloalkyloxy group, an aryloxy group, an acyl group or an acyloxy group, provided that $R_2$ through $R_4$ each is a halogen atom, an alkyl group or an alkoxy group.

14. The electrophotographic photoreceptor of claim 1, wherein said silica particles each contain an aluminum ingredient of 1 to 200 ppm, a calcium ingredient of 1 to 200 ppm and an iron ingredient of 1 to 200 ppm.

15. The electrophotographic photoreceptor of claim 4, wherein said silica particle has a major axis/a minor axis ratio of less than 2.0.

16. The electrophotographic photoreceptor of claim 1, wherein said silica particles have a volume average particle size of 0.1 through 2 μm.

17. The electrophotographic photoreceptor of claim 1, wherein said carrier transport layer has a layer thickness of 5 to 50 μm.

18. An electrophotographic photoreceptor comprising a conductive support and provided thereon an intermediate layer, a carrier generation layer, a carrier transport layer and a protective layer as an outermost layer, wherein said protective layer contains a carrier transport material and substantially spherical silica particles each containing an aluminum ingredient of not more than 1000 ppm, a calcium ingredient of not more than 300 ppm and an iron ingredient of not more than 1000 ppm, said silica particles have a volume average particle size of 0.05 through 5 μm said silica particles have a specific volume resistivity of more than $10^{10}$ Ω·cm, and said silica particles are stored under the conditions having a relative humidity of 80%, and immediately, said silica particles are analyzed with a differential scanning calorimeter in a temperature range of 40° to 200° C., said silica particles show a heat-absorption energy variation amount (ΔH) of 0 to 20 Joule/g.

* * * * *